US011493257B2

(12) United States Patent
Kim et al.

(10) Patent No.: US 11,493,257 B2
(45) Date of Patent: Nov. 8, 2022

(54) ENTRANCE REFRIGERATOR

(71) Applicant: LG ELECTRONICS INC., Seoul (KR)

(72) Inventors: Daewoong Kim, Seoul (KR); Minkyu Oh, Seoul (KR); Boan Kwon, Seoul (KR); Wonjin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 157 days.

(21) Appl. No.: 16/886,068

(22) Filed: May 28, 2020

(65) Prior Publication Data

US 2021/0207868 A1 Jul. 8, 2021

(30) Foreign Application Priority Data

Jan. 2, 2020 (KR) ..... 10-2020-0000078

(51) Int. Cl.

| | |
|---|---|
| ***F25D 13/00*** | (2006.01) |
| ***F25B 21/02*** | (2006.01) |
| ***F25D 17/06*** | (2006.01) |
| *E06B 1/52* | (2006.01) |

(52) U.S. Cl.

CPC ..... *F25D 13/00* (2013.01); *F25B 21/02* (2013.01); *F25D 17/06* (2013.01); *E06B 1/52* (2013.01); *F25B 2321/0251* (2013.01)

(58) Field of Classification Search

CPC ..... F25D 13/00; F25D 2317/063; F25D 2323/0021; F25D 2323/0022; F25D 17/06; F25D 19/00; F25D 23/10; F25D 13/02; F25D 23/12; F25D 2321/146; F25D 2321/1442; F25D 2317/0682; F25D 2317/0664; F25D 19/04; F25D 11/025; F25B 21/02; F25B 2321/0251; F25B 2321/02; E06B 1/25

See application file for complete search history.

(56) References Cited

U.S. PATENT DOCUMENTS

| | | | | |
|---|---|---|---|---|
| 3,078,682 | A | 2/1963 | Gould | |
| 3,673,735 | A | 7/1972 | Winsler et al. | |
| 2005/0120738 | A1 | 6/2005 | Chun et al. | |
| 2006/0000221 | A1 | 1/2006 | Culp et al. | |
| 2007/0125100 | A1 | 6/2007 | Shoenfeld | |
| 2011/0283727 | A1 | 11/2011 | Gracie | |
| 2015/0075184 | A1* | 3/2015 | Edwards | F28D 15/0266 62/3.2 |
| 2015/0338155 | A1 | 11/2015 | Heinzle et al. | |
| 2018/0142935 | A1 | 5/2018 | Jacobi | |
| 2018/0238603 | A1 | 8/2018 | Takami et al. | |
| 2018/0274825 | A1 | 9/2018 | Choi et al. | |
| 2018/0274826 | A1* | 9/2018 | Kim | F25B 21/04 |

(Continued)

FOREIGN PATENT DOCUMENTS

| | | | |
|---|---|---|---|
| CA | 2 461 635 | A1 | 9/2005 |
| CN | 85 1 09180 | A | 5/1986 |

(Continued)

*Primary Examiner* — Cassey D Bauer

(74) *Attorney, Agent, or Firm* — Birch, Stewart, Kolasch & Birch, LLP

(57) ABSTRACT

An entrance refrigerator includes an upper first cold air supply on an upper portion and a lower second cold air supply on a lower portion, and an external air guide provided between the upper first cold air supply and the lower second cold air supply.

18 Claims, 19 Drawing Sheets

(56) References Cited

U.S. PATENT DOCUMENTS

| | | | |
|---|---|---|---|
| 2018/0363969 | A1 | 12/2018 | Jacobi |
| 2019/0178559 | A1 | 6/2019 | Lee et al. |
| 2019/0186806 | A1 | 6/2019 | Oh |
| 2019/0231106 | A1 | 8/2019 | Kaiserman et al. |
| 2019/0282015 | A1 | 9/2019 | High et al. |
| 2019/0335921 | A1 | 11/2019 | Jakobsen |
| 2020/0018526 | A1 | 1/2020 | Oh et al. |

FOREIGN PATENT DOCUMENTS

| | | | | | |
|---|---|---|---|---|---|
| CN | 101653330 | A | | 2/2010 | |
| CN | 103185446 | A | * | 7/2013 | ..... F25C 1/00 |
| CN | 105556222 | A | | 5/2016 | |
| CN | 107270643 | A | | 10/2017 | |
| CN | 107461986 | A | | 12/2017 | |
| CN | 107883643 | A | | 4/2018 | |
| CN | 108458534 | A | | 8/2018 | |
| CN | 108626932 | A | | 10/2018 | |
| CN | 108800712 | A | | 11/2018 | |
| CN | 109269189 | A | | 1/2019 | |
| CN | 109838968 | A | | 6/2019 | |
| CN | 110017643 | A | | 7/2019 | |
| CN | 110390775 | A | * | 10/2019 | |
| CN | 209689273 | U | | 11/2019 | |
| DE | 88 06 978 | U1 | | 8/1988 | |
| DE | 10 2009 001 825 | A1 | | 9/2010 | |
| EP | 0920686 | A1 | | 6/1999 | |
| EP | 2 924 376 | A1 | | 9/2015 | |
| EP | 3 301 385 | A1 | | 4/2018 | |
| EP | 3 511 663 | A1 | | 7/2019 | |
| GB | 2 167 544 | A | | 5/1986 | |
| JP | 3-140776 | A | | 6/1991 | |
| JP | 10-245095 | A | | 9/1998 | |
| JP | 2000-227271 | A | | 8/2000 | |
| JP | 2001-41639 | A | | 2/2001 | |
| JP | 2003072897 | A | * | 3/2003 | ..... F25B 21/02 |
| JP | 2008-32316 | A | | 2/2008 | |
| JP | 2009-79878 | A | | 4/2009 | |
| JP | 2016-130609 | A | | 7/2016 | |
| KR | 20-0357547 | Y1 | | 7/2004 | |
| KR | 10-0828045 | B1 | | 5/2008 | |
| KR | 10-2013-0017001 | A | | 2/2013 | |
| KR | 10-2013-0071669 | A | | 7/2013 | |
| WO | WO 2017/197304 | A1 | | 11/2017 | |
| WO | WO-2018073990 | A1 | * | 4/2018 | ..... F25D 11/00 |
| WO | WO 2018/169178 | A1 | | 9/2018 | |
| WO | WO 2018/196680 | A1 | | 11/2018 | |

* cited by examiner

ENTRANCE REFRIGERATOR

CROSS-REFERENCE TO RELATED APPLICATIONS

This application claims the priority benefit of the Korean Patent Application No. 10-2020-0000078 filed in the Republic of Korea on Jan. 2, 2020, which is hereby incorporated by reference as if fully set forth herein.

BACKGROUND

Field of the Invention

The present disclosure relates to an entrance refrigerator. That is, the present disclosure is directed to a refrigerator provided at an entrance to a building, such as a residence.

Discussion of the Related Art

Recently, delivery services for delivering articles (or goods) to a certain place has been commonplace. In particular, when the article to be delivered is fresh food, the fresh food may be stored and delivered in a refrigerator or in a warmer, the refrigerator or warmer may be provided in a delivery vehicle, in order to prevent the food from being spoiled or cooled.

Food is generally delivered in a packing material to maintain a cooling or warming state. The packing material is formed of environmental pollutants, such as Styrofoam® or an extruded polystyrene foam or other insulating material. There is an increasing need to reduce the environmental pollutants, including socially and economically.

Additionally, if a user is at home at a delivery time, the user may directly receive food from a courier (i.e., a delivery person) face to face, but if the user is not at home, such as when the delivery time is too early or late, it may be difficult for the user to directly receive food from the courier face to face.

Therefore, there is a need for food to be received even if the user does not come into direct contact with a courier and there is a need for food not to be spoiled or to be overly cooled until the food is finally delivered to the user. That is, there is a need to maintain the food in the manner in which it was delivered, including the temperature it was delivered, in order to preserve its freshness or to keep the food at a desired temperature for consumption.

In order to solve these above problems, recently, a product, such as a refrigerator, is installed at an entrance (e.g., front door) of a user's residence or other place, so that the courier may store the delivered food in the refrigerator to keep the food fresh and the user may access the refrigerator at a convenient time to receive the food.

A related art below discloses an entrance refrigerator provided to be mounted on an entrance door or embedded (e.g., provided) in a wall that borders an entrance hallway.

Related art: Korean Utility Model Registration No. 20-0357547, dated Jul. 19, 2004.

The entrance refrigerator embedded (e.g., provided) in a wall disclosed in the related art has the following problems.

First, although a conventional cooling device is described as being installed on the bottom of a storage compartment, there is no reference to a type or design structure of a specific cooling device.

Second, it is described that heat generated in the cooling device is discharged to an outdoor corridor. In the case of the structure, outsiders that pass by the corridor may be in direct contact with heat to cause discomfort.

Third, in summer, heat generated in the cooling device may be discharged to the outdoor corridor to increase a temperature of the air in the corridor.

Fourth, when the cold air supply device is disposed on the bottom of the storage compartment, a temperature difference occurs between upper and lower sides of the storage compartment, causing a phenomenon that the temperature of the storage compartment is not uniform (e.g., the storage compartment has a varying temperature throughout due to the temperature difference occurring between upper and lower sides of the storage compartment.

The present disclosure is proposed to improve a technical problem of the wall-embedded entrance refrigerator of the related art.

SUMMARY

To achieve these and other advantages and in accordance with the purpose of the disclosure, as embodied and broadly described herein, there is provided an entrance refrigerator in which a cold air supply module (e.g., assembly, unit) is provided on each of an upper portion and a lower portion of a rear surface of a cabinet and an external air guide is provided between an upper first cold air supply module and a lower second cold air supply module.

The entrance refrigerator according to the present disclosure may include a first heat dissipation cover configured to cover a heat sink and a heat dissipation fan of the first cold air supply module and a second heat dissipation cover configured to cover a heat sink and a heat dissipation fan of the second cold air supply module, and the external air guide may be provided at an upper surface portion of the second heat dissipation cover or a lower surface portion of the first heat dissipation cover.

The external air guide may extend upward in a state of being spaced apart from a side surface portion of the first heat dissipation cover, and at least a portion thereof may be inclined or rounded.

An upper end of the external air guide may have a vertical portion and may be located between an upper surface portion and the lower surface portion of the first heat dissipation cover.

A plurality of heat dissipation holes may be provided at a portion excluding the upper surface portion and the lower surface portion of the heat dissipation cover.

According to the entrance refrigerator according to an embodiment of the present disclosure, a courier may deliver a delivery article without having to come into contact with a home owner in an outdoor area.

In addition, since the cold air supply module including a thermoelectric element is used as a means for maintaining a temperature inside the refrigerator at a refrigerating temperature or a warming temperature, a size of a storage space is maximized and a size of a space in which the cold air supply module is accommodated may be minimized.

In addition, since heat generated in the cold air supply module is discharged upward in an indoor area, a phenomenon that a person passing by an outdoor corridor is uncomfortable does not occur.

In addition, a phenomenon that heat emitted to the outside of the heat dissipation cover is introduced into the upper heat dissipation cover by the lower heat dissipation fan to degrade heat exchange performance of the upper cold air supply module may be minimized.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Hereinafter, an entrance refrigerator according to embodiments of the present disclosure will be described in detail with reference to the accompanying drawings.

Figure 1:
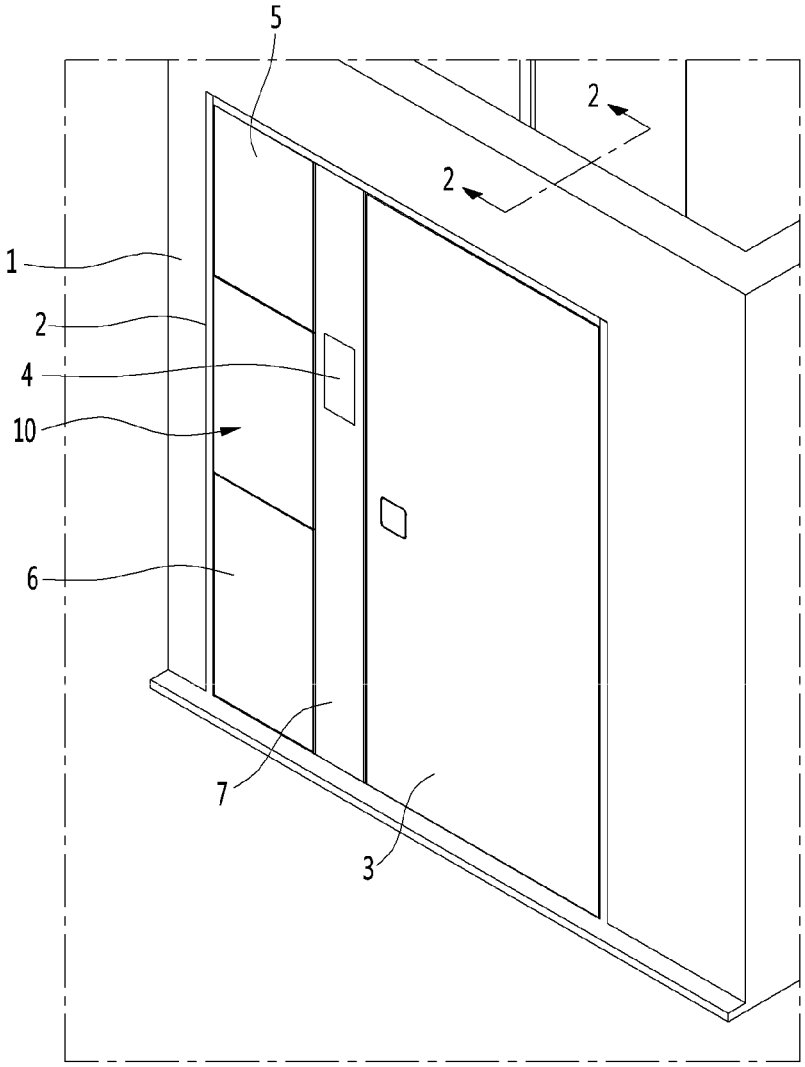
FIG. 1 is a front perspective view of an entrance equipped with an entrance refrigerator according to an embodiment of the present disclosure.
Figure 2:
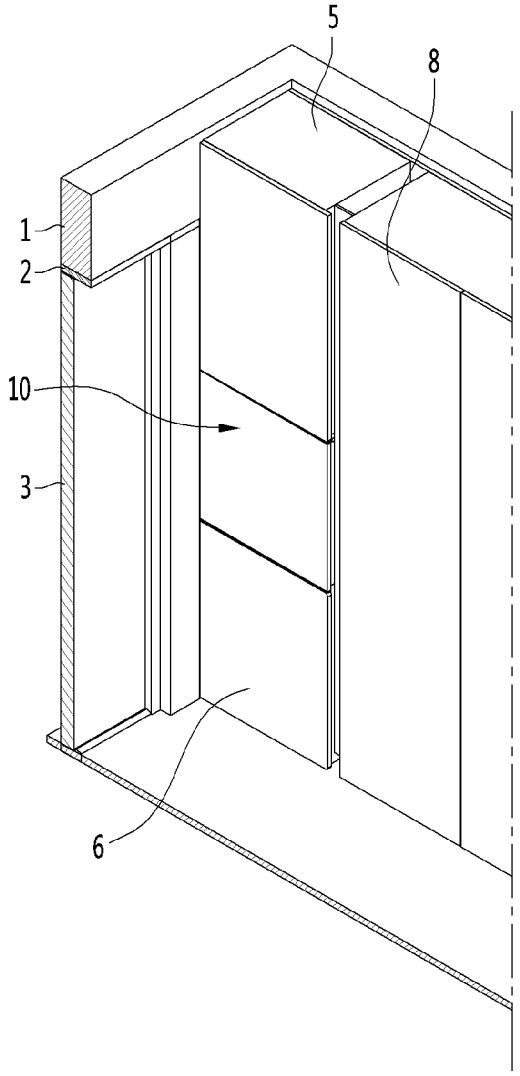
FIG. 2 is a perspective view showing the inside of an entrance taken along line 2-2 of FIG. 1.

FIG. 1 is a front perspective view of an entrance equipped with an entrance refrigerator according to an embodiment of the present disclosure, and FIG. 2 is a cutaway perspective view showing an inside of an entrance taken along line 2-2 of FIG. 1.

Referring to FIGS. 1 and 2, an opening is formed on an outer wall 1 partitioning an indoor area and a corridor, and a frame 2 is provided at the edge of the opening. That is, the frame 2 is attached to the opening of the outer wall 1. In addition, an entrance door 3 may be installed inside the frame 2, and an entrance refrigerator 10 may be disposed on a side of the entrance door 3 (e.g., the entrance refrigerator 10 may be positioned within the frame and adjacent to the entrance door 3).

A partition or a partition wall 7 may be formed between the entrance door 3 and the entrance refrigerator 10, and the partition 7 opens and closes the entrance door 3, which may be a front door. The partition 7 may have a control panel 4 for controlling opening and closing of the entrance door 3 and opening and closing of a door 12 (see FIG. 3) of the entrance refrigerator 10.

The control panel 4 may include at least one of a face recognition sensor for recognizing a face of an approaching person, a code reader for recognizing an encryption code of a delivery service article to be stored in the entrance refrigerator 10, a proximity sensor, a controller (e.g., processor, CPU) and a display unit. Further, the at least one face recognition sensor, the code reader, and the proximity sensor of the code reader 4 may be installed at one side or multiple sides of the control panel 4. A face image of an approaching person, recognized by the face recognition sensor, may be displayed on the display unit of the control panel 4.

In addition, a controller of the control panel 4 may perform a function of controlling opening and closing of an outdoor side door and an indoor side door of the entrance refrigerator 10, as well as a function of controlling opening and closing of the entrance door 3, according to a result of the face recognition.

For example, the controller of the control panel 4 may perform a function of opening an outdoor side door of the entrance refrigerator 10 according to a result of recognizing a delivery article and automatically perform a function of locking the outdoor side door when the outdoor side door is recognized to be closed.

In addition, in a state where one of the outdoor side door and an indoor side door of the entrance refrigerator 10 is open, the controller of the control panel 4 may maintain the other in a closed state.

Alternatively, an independent control panel may be provided for performing the functions on the indoor side door of the entrance refrigerator or the outdoor side door of the entrance refrigerator 10 described above with respect to the control panel 4.

Additionally, an upper side (e.g., upper portion) of the entrance refrigerator 10 may be provided with a first storage 5, and a lower side (e.g., lower portion) thereof, below the first storage 5, may be provided with a second storage 6. The first storage 5 may function as a warmer for storing articles in a warmed state. In addition, the second storage 6 may be maintained at room temperature to simply perform a function of storing a delivery service article (e.g., an article not needing to be maintained a particular temperature) or may be maintained at a temperature different from an internal temperature of the entrance refrigerator 10. Alternatively, the second storage may be maintained at a temperature lower than room temperature.

The first storage 5 may be maintained at a refrigerating temperature or freezing temperature, and the second storage 6 may be used as a space maintained at room temperature so as to perform only a function of storing a delivery service article.

Additionally, one or a plurality of third storages 8 may be installed on an indoor entrance side wall corresponding to a rear of the entrance refrigerator 10. The third storage 8 may be adjacent to the first storage 5 and the second storage 6, including between the first storage 5 and the entrance door 3 and between the second storage 6 and the entrance door 3. The third storage 8 may be used as a space for storing shoes, umbrellas, or laundry.

Figure 3:
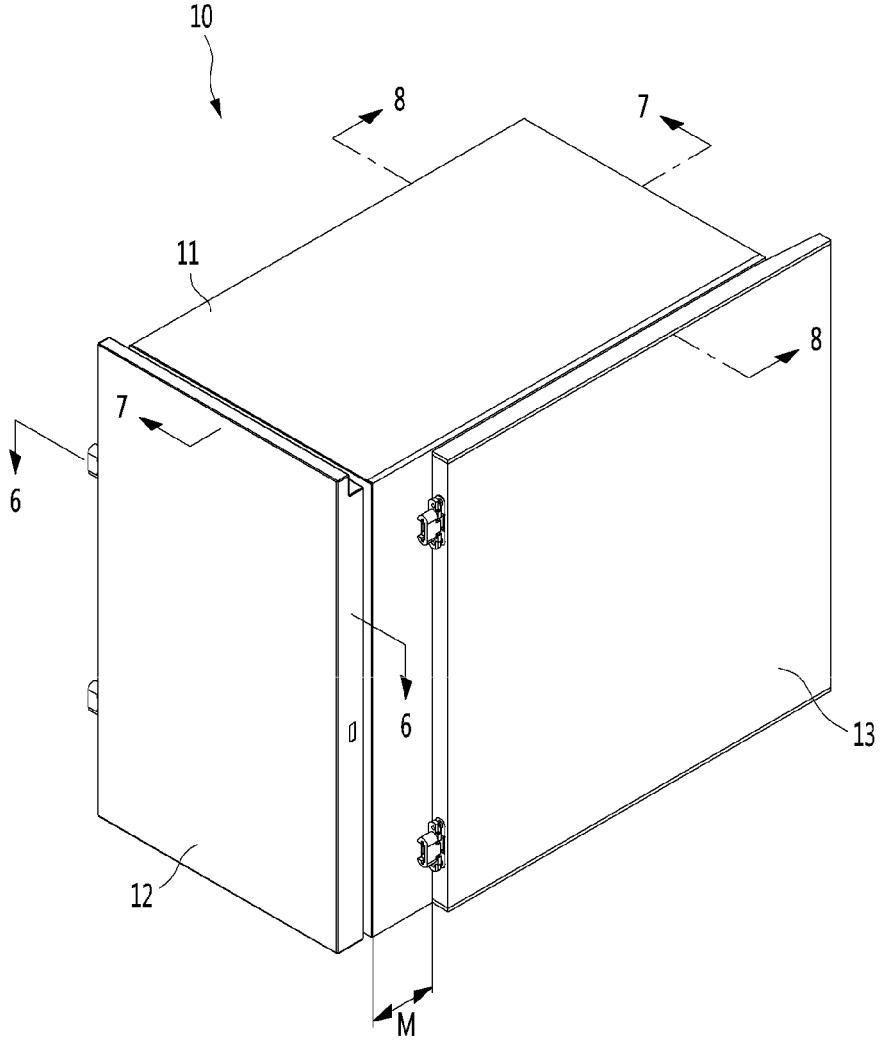
FIG. 3 is a front perspective view of an entrance refrigerator according to an embodiment of the present disclosure.
Figure 4:
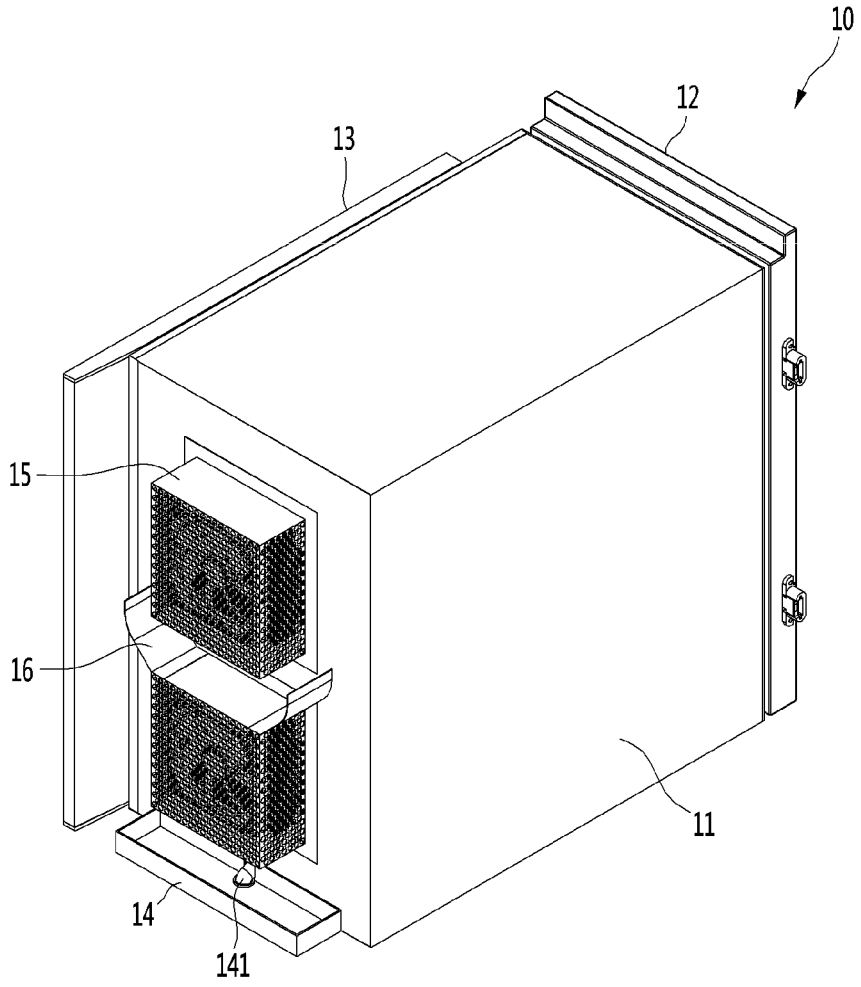
FIG. 4 is a rear perspective view of the entrance refrigerator.
Figure 5:
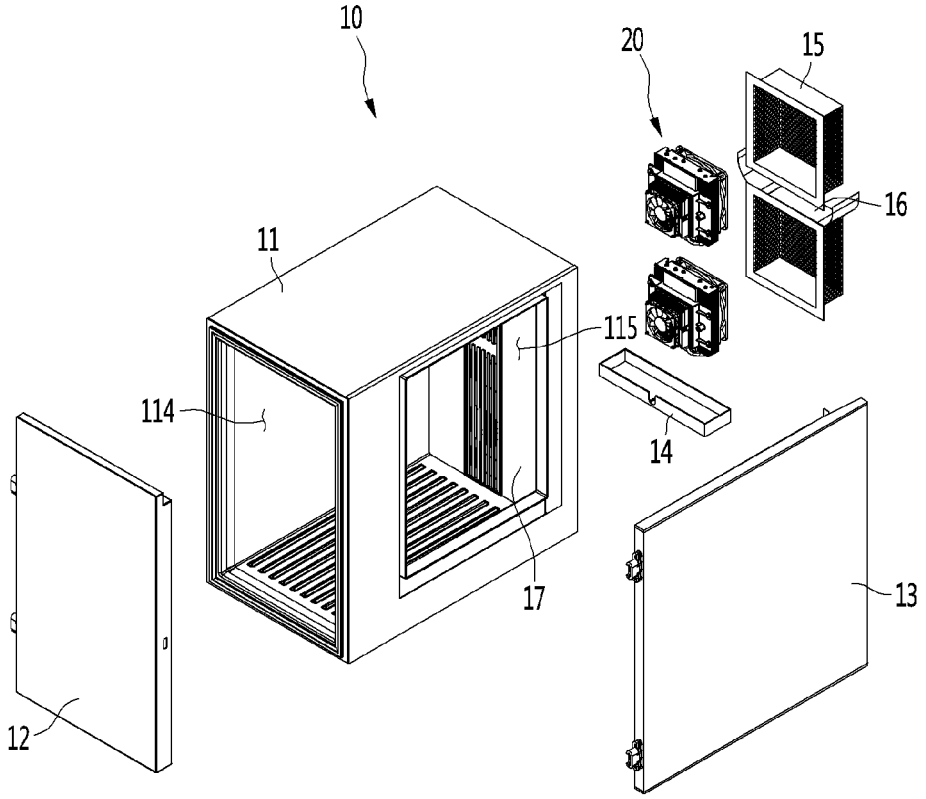
FIG. 5 is an exploded perspective view of the entrance refrigerator.
Figure 6:
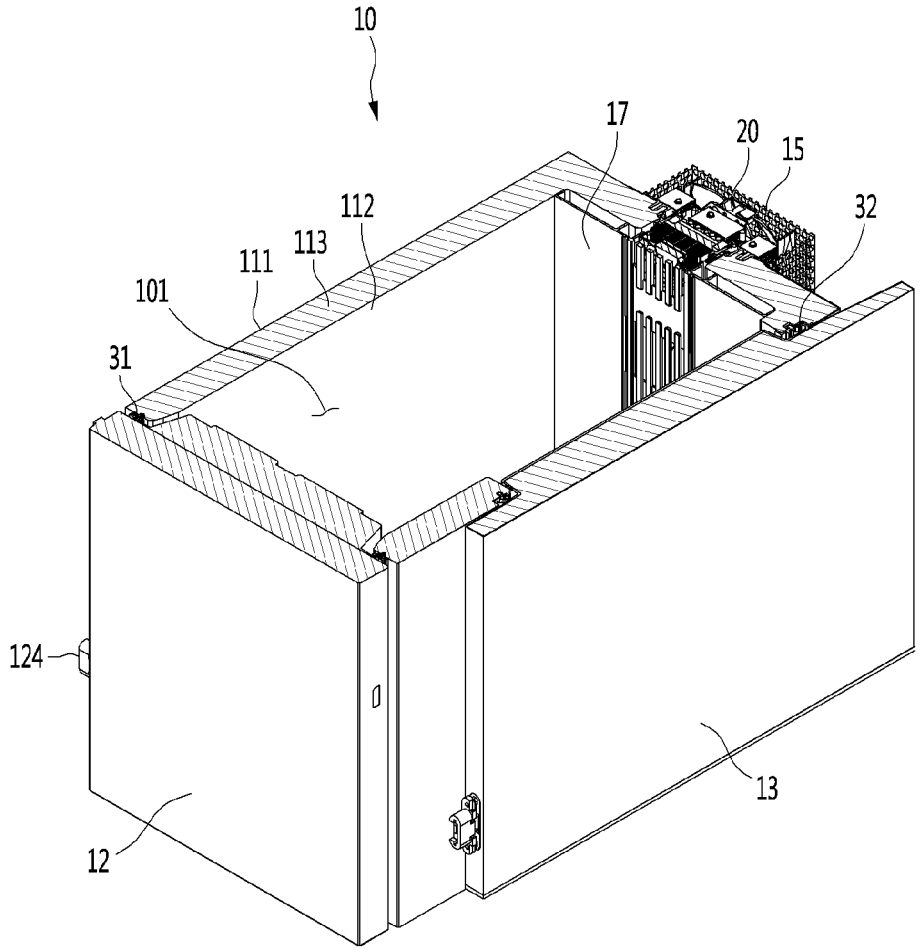
FIG. 6 is a cross-sectional cutaway perspective view of the entrance refrigerator taken along line 6-6 of FIG. 3.
Figure 7:
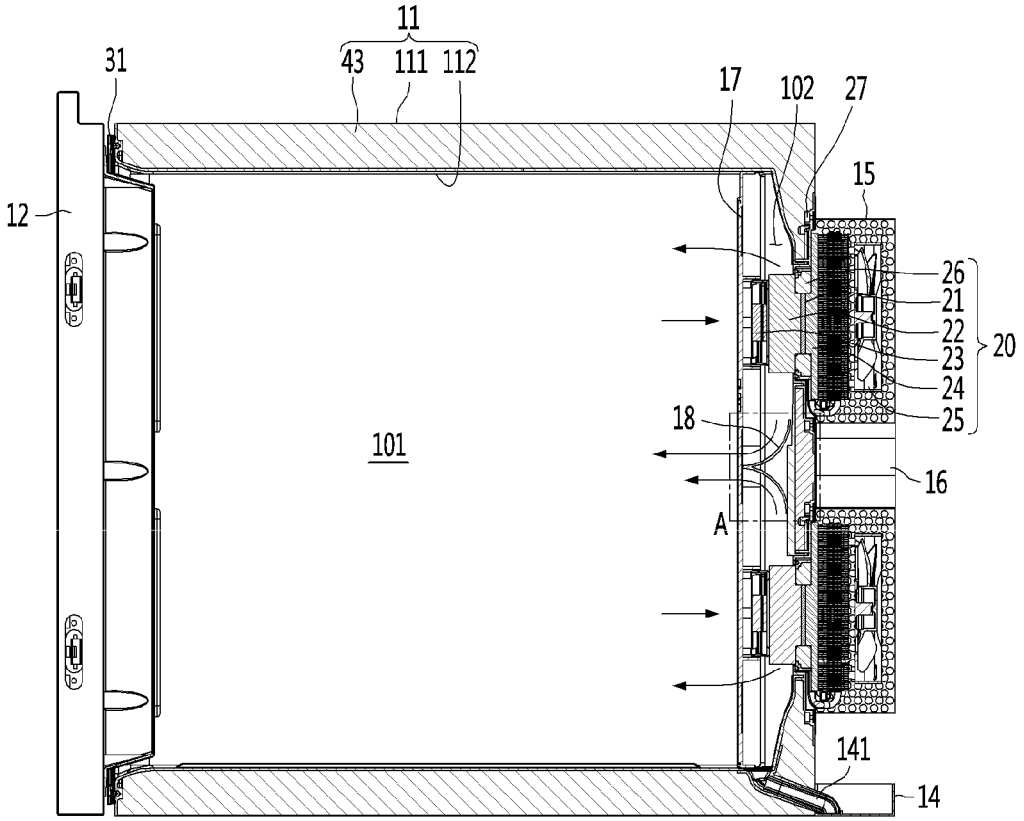
FIG. 7 is a side cross-sectional view of the entrance refrigerator taken along line 7-7 of FIG. 3.
Figure 8:
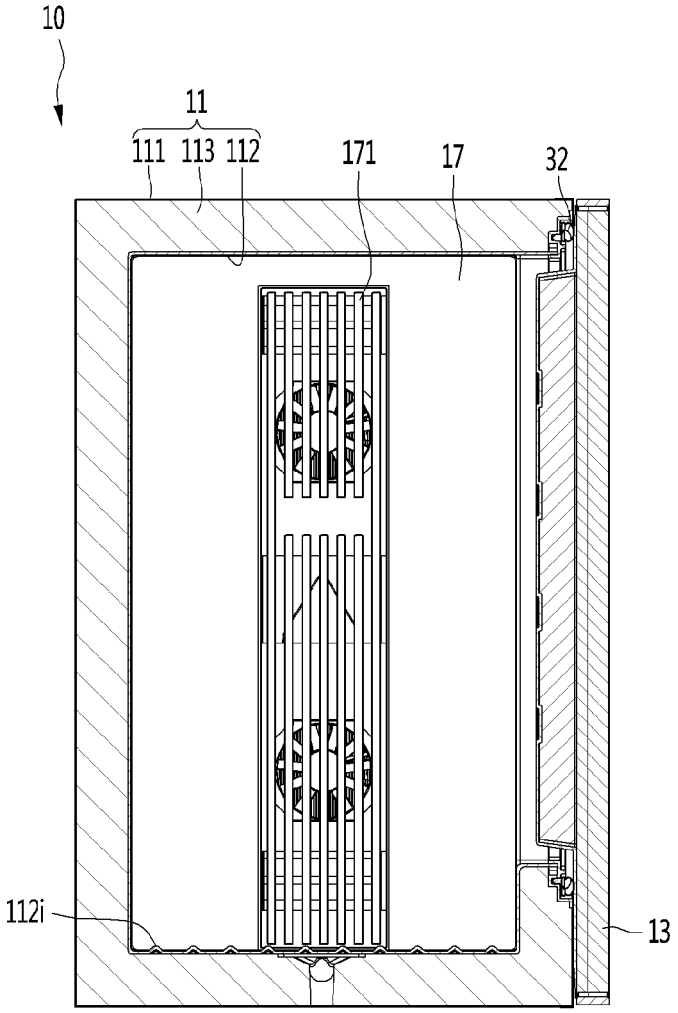
FIG. 8 is a longitudinal cross-sectional view of the entrance refrigerator taken along line 8-8 of FIG. 3.

FIG. 3 is a front perspective view of an entrance refrigerator according to an embodiment of the present disclosure, FIG. 4 is a rear perspective view of the entrance refrigerator, FIG. 5 is an exploded perspective view of the entrance refrigerator, FIG. 6 is a cross-sectional cutaway perspective view of the entrance refrigerator taken along line 6-6 of FIG. 3, FIG. 7 is a side cross-sectional view of the entrance refrigerator taken along line 7-7 of FIG. 3, and FIG. 8 is a longitudinal cross-sectional view of the entrance refrigerator taken along line 8-8 of FIG. 3.

Referring to FIGS. 3 to 8, the entrance refrigerator 10 according to an embodiment of the present disclosure may be a wall-embedded refrigerator in which a front portion passes through an outer wall 1.

Specifically, the entrance refrigerator 10 may include a cabinet 11 partially embedded in an outer wall 1 (e.g., an entrance/front wall of a dwelling/building), an outer door 12 for opening and closing an outer opening 114 provided at a front end of the cabinet 11, an inner door 13 for opening and closing an inner opening 115 provided on a side surface of the cabinet 11, and one or a plurality of cold air supply modules (e.g., assemblies) 20 mounted on a rear surface of the cabinet 11.

Here, the outer opening 114 may be provided on a front surface of the cabinet 11 and may be defined as a front opening, and the inner opening 115 may be provided on the side surface of the cabinet 11, adjacent to the outer opening 114, and may be defined as a side opening.

Alternatively, one of the outer opening 114 and the inner opening 115 may be defined as a first opening and the other may be defined as a second opening. One of the outer door 12 and the inner door 13 may be defined as a first door and the other may be defined as a second door.

In addition, a range in which the entrance refrigerator 10 is mounted on the outer wall 1 partitioning the indoor area and outdoor area may include the entrance refrigerator 10 being attached (e.g., embedded, connected) to a wall that partitions multiple indoor spaces, including a first indoor space and a second indoor space, or a wall that partitions an indoor area and an outer corridor.

For example, the entrance refrigerator 10 may be attached/embedded in a wall formed between an entrance door and a middle door that separates the entrance and a room of a home, such as a kitchen. In this case, when an article is input in the entrance, the article may be taken out in the kitchen on the other side.

Therefore, one of a space where the outer door 12 is exposed and a space where the inner door 13 is exposed may be defined as a first space, and the other may be defined as a second space. One of the first space and the second space may include one of an indoor space or an outdoor space, and the other of the first space and the second space may include an indoor space.

In another aspect, the space to which the door that is opened to store the delivery service article is exposed may be one of the indoor space and the outdoor space, and the space to which the door that is opened to take out the delivered article is exposed may be the indoor space.

In addition, the entrance refrigerator 10 may further include a heat dissipation cover 15 covering a rear surface of the cold air supply module 20 and an external air guide 16 guiding a flow of heat dissipation air discharged through the heat dissipation cover 15.

In this embodiment, a pair of cold air supply modules 20 are arranged up and down, and a pair of heat dissipation covers 15 cover the cold air supply modules 20, respectively. In addition, the external air guide 16 may be disposed between the pair of heat dissipation covers 15 disposed up and down and may function to guide the flow of heat dissipation air discharged from the lower heat dissipation cover 15.

The pair of cold air supply modules 20 may be defined as an upper first cold air supply module and a lower second cold air supply module.

Here, a structure in which a single cold air supply module 20 is disposed at the center of a rear surface of the cabinet 11 also falls within the scope of the present disclosure, in which the external air guide 16 may not be necessary.

The heat dissipation cover 15 may have a hexahedral shape, a front surface thereof may be open, and a flange may be bent extending from the open front surface and may be fixed to a rear surface of the cabinet 11.

A plurality of air vents may be formed only on rear, left, and right surfaces excluding the upper and lower surfaces of the heat dissipation cover 15. By this structure, indoor air may flow into the heat dissipation cover 15 through the air vent formed on the rear surface of the heat dissipation cover 15, and after heat exchange, the air may be discharged to the outside of the heat dissipation cover 15 through the air vents formed on the left surface and the right surface of the heat dissipation cover 15.

In addition, the entrance refrigerator 10 may further include a guide plate 17 disposed on a rear side in the cabinet 11. The guide plate 17 may be a partition member partitioning the inner space (e.g., interior space) of the cabinet 11 into a cold air generating compartment 102 (see FIG. 7) in which the cold air supply module 20 is accommodated and a storage compartment 101 in which a delivery service article is stored.

In addition, the entrance refrigerator 10 may further include a drain pan 14 and a drain hose 141 mounted at a lower end of the rear surface of the cabinet 11. The drain hose 141 extends from the bottom of the cold air generating compartment 102 to the drain pan 14 through the lower end of the rear surface of the cabinet 11. Therefore, condensate water collected at the bottom of the cold air generating compartment 102 is transported to the drain pan 14 through the drain hose 141 (e.g., the condensate water is collected by the drain pan 14).

Additionally, at least the front surface of the outer door 12 is exposed to the outdoor area and a courier that is authenticated may open the outer door 12. A front surface of the outer door 12 may be coplanar with or slightly protrude from, the front surfaces of the first storage 5 and second storage 6. Alternatively, the front surface of the outer door 12 may be designed to be coplanar with or slightly protrude from the outer wall 1.

The outer door 12 may be provided without a separate handle structure, in order to prevent easy access by a person, including a person who is not allowed access. When the outer door 12 is provided without a handle structure, if a delivery service article is recognized and authenticated by an authentication unit mounted on one side of the outer door 12 or on the control panel 4, the controller installed in the control panel 4 or the entrance refrigerator 10 may release a locked state of the outer door 12 and the controller operates a separate driving unit for pushing the outer door 12 so that the outer door 12 rotates forward by a predetermined angle, so that the courier may easily open the outer door.

In addition, when the article storage is completed (e.g., the article is stored in the cabinet 11) and the courier/person closes the outer door 12, the controller may return the outer door to a locked state.

In addition, in FIG. 3, a distance M from a front end of the cabinet 11 to a left surface of the inner door 13 may correspond to a thickness of the outer wall 1. A hinge of the inner door 13 may be installed at the cabinet 11 or may be installed in a portion other than the cabinet 11 including the outer wall 1. The hinge of the inner door 13 may allow the inner door 13 to rotate about the hinge between an open position and a closed position.

Further, a hinge 124 of the inner door 12 may also be installed at the cabinet 11 or may be installed at a portion other than the cabinet 11 including the outer wall 1. The hinge of the inner door 12 may allow the inner door 12 to rotate about the hinge between an open position and a closed position.

In addition, the cabinet 11 includes an outer case 111 forming an appearance, an inner case 112 positioned inside the outer case 111 to define the storage compartment 101, and a heat insulating material 113 filling a space between the outer case 111 and the inner case 112.

A plurality of protrusions 112*i* (see FIG. 8) may protrude from a bottom of the inner case 112. The plurality of protrusions 112*i* may extend from a front end to a rear end of the inner case 112 and protrude upward from the bottom of the inner case 112.

In addition, the plurality of protrusions 112*i* may be arranged to be spaced apart from each other at a predetermined interval in a widthwise direction of the inner case 112.

Since the plurality of protrusions 112*i* are formed at the bottom of the inner case 112, when a delivery service article that is heavy is pushed into and received in the storage compartment 101, the delivery service article may come into contact with the plurality of protrusions 112*i* formed on bottom of the inner case 112, thereby minimizing a frictional force as compared to contacting the entirety of the bottom of the inner case 12. Further, each of the plurality of protrusions 112*i* may be formed as a line protruding upwards from the bottom of the inner case 12, starting substantially from the outer opening 114 to an opposite side of the inner case 12.

The plurality of protrusions 112*i* may have a circular (e.g., dot) or hemispherical shape and may be arranged at a predetermined interval so as to come into point contact with a bottom surface of a delivery service article, thereby reducing a frictional force.

In addition, an outer gasket 31 is mounted on a front surface of the cabinet 11 corresponding to the edge of the outer opening 114, and an inner gasket 32 is mounted on a side surface of the cabinet 11 corresponding to the edge of the inner opening 115. The outer gasket 31 and the inner gasket 32 may be made of a material known in the art (i.e., the field of refrigeration and heating).

In addition, an inner air guide 18 is mounted on a rear surface of the guide plate 17 to guide cold air supplied from the cold air supply module 20 to the storage compartment 101.

Additionally, the cold air supply module 20 includes a cold air supply unit to which a thermoelectric element is applied. When a current is supplied (e.g., applied), one surface (e.g., a first surface) of the thermoelectric element acts as an endothermic surface absorbing heat as a temperature is decreased, and the other surface (e.g., a second surface opposite to the first surface) thereof acts as an exothermic surface dissipating heat as a temperature is increased.

The cold air supply module 20 may include a thermoelectric element 21, a cold sink 22 attached to the endothermic surface of the thermoelectric element 21, a heat sink 24 attached to the exothermic surface of the thermoelectric element 21, a heat absorption fan 23 placed (e.g., positioned) in front of the cold sink 22, a heat dissipation fan 25 placed (e.g., positioned) behind the heat sink 24, and an insulation block 26 surrounding the edges of the thermoelectric element 21.

Specifically, as shown in FIG. 7, the cold air supply module 20, may be mounted in a mounting hole formed on the rear surface of the cabinet 11. In a case where the pair of cold air supply modules 20 are disposed to be spaced apart in an up and down (e.g., vertical) direction, a first cold air supply module may be disposed at a lower portion of the rear surface of the cabinet 11 and a second cold air supply module may be mounted at a position/point on the rear surface of the cabinet corresponding spaced apart upward from the first cold air supply module.

The inner air guide 18 may be located between a heat absorption fan of the first cold air supply module and a heat absorption fan of the second cold air supply module. Due to the inner air guide 18, cold air flowing by the heat absorption fan of the first cold air supply module and cold air flowing by the heat absorption fan of the second cold air supply module may not be mixed and supplied to the storage compartment.

At least one or both of the heat absorption fan 23 and the heat dissipation fan 25 may be an axial flow fan or a centrifugal fan.

Each cold sink 22 includes a sink body and a plurality of heat exchange fins arranged on a front surface of the sink body. A rear surface of the sink body is in close contact with the front surface of the thermoelectric element 21, the heat exchange fins may be perpendicular to the front surface of the sink body. The plurality of heat exchange fins are spaced apart from each other in a widthwise direction of the sink body. Therefore, cold air inside the storage compartment 101 pulled in by the heat absorption fan 23 hits the front surface of the sink body and flows in an up-down direction through flow paths formed between the plurality of heat exchange fins in a distributed manner. The cold air cooled while exchanging heat with the cold sink 22 passes through a discharge grille 171 (see FIG. 8) formed at the guide plate 17 along the inner air guide 18 and then is supplied to the storage compartment 101.

Like the cold sink 22, the heat sink 24 may include a sink body whose rear surface is attached to the exothermic surface of the thermoelectric element 21 and a plurality of heat exchange fins extending from a front surface of the sink body.

Since the heat sink 24 must have a larger heat exchange amount than the cold sink 22, the heat sink 24 may have a larger volume than the cold sink 22, and a heat transfer unit such as a heat pipe may be additionally installed therein. This is due to physical properties that a cooling capacity of the thermoelectric element decreases as a temperature difference between the endothermic surface and the exothermic surface increases. Therefore, in order to maximize the cooling capacity of the thermoelectric element 21, a heat dissipation capacity of the heat sink 24 is set larger than that of the cold sink 22.

In addition, since the heat exchange fins of the heat sink 24 extend in a horizontal direction and are spaced apart from each other in a vertical direction, ambient air (e.g., indoor air) pulled in by the heat dissipation fan 25 hits (e.g., contacts) the surface of the sink body of the heat sink 24 and then dividedly flow in a left-right direction.

In particular, the heat dissipation air dividedly flowing to the left and right after hitting the heat sink 24 at the lower side so as to be heat-exchanged hits a bottom surface of the external air guide 16 and is guided to flow dividedly to the left and right of the heat dissipation cover 15.

Additionally, condensate water formed on a surface of the cold sink 22 flows to the bottom of the cold air generating compartment 102 and is collected to a drain pan 14 through a drain hose 141. The drain hose 141 extends to the drain pan 14 from the bottom of the inner case 112, which defines the bottom of the cold air generating compartment 102, through the cabinet 11.

Figure 9:
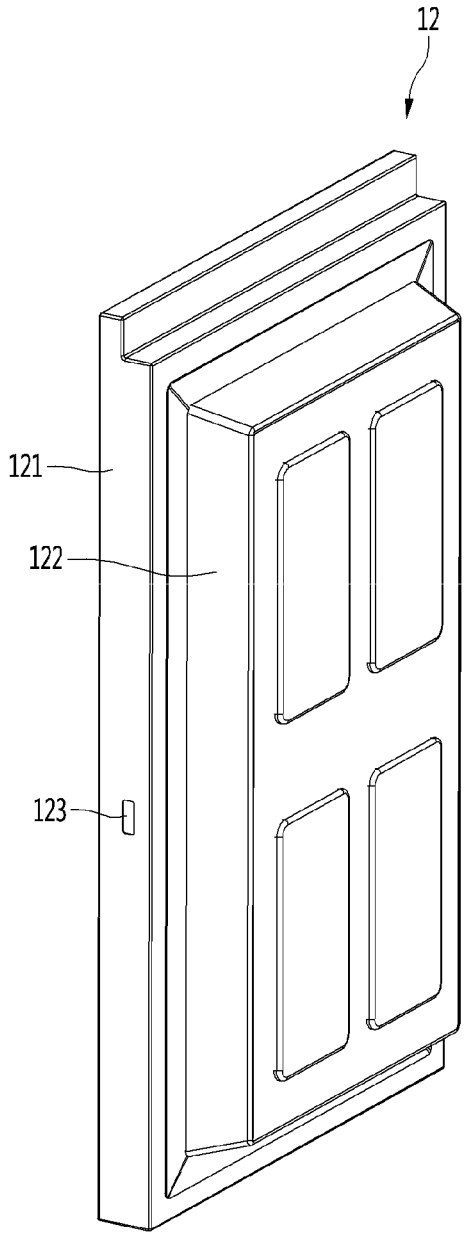
FIG. 9 is a rear perspective view of an outer door of an entrance refrigerator according to an embodiment of the present disclosure.

FIG. 9 is a rear perspective view of an outer door of an entrance refrigerator according to an embodiment of the present disclosure.

Referring to FIG. 9, the outer door 12 of the entrance refrigerator 10 according to an embodiment of the present disclosure may include a door body 121 and a door liner 122 protruding from a rear surface of the door body 121. The door liner 122 may encompass an entire rear surface of the door body 121 or may encompass less than an entire rear surface of the door body 121, such as shown in FIG. 9.

The door body 121 may be formed of a metal having a fireproofing function that may tolerate a flame when a fire breaks out in the outdoor corridor. The door body 121 may be filled with a fire resistant block.

In addition, the door liner 122 is a portion led into (e.g., extends into) the storage compartment 101 through the outer opening 114 when the outer door 12 is closed. Therefore, the door liner 122 may be filled with insulation foam so that cold air of the storage compartment 101 is not leaked to the outside by heat conduction.

When the outer door 12 is closed, the outer gasket 31 (see FIG. 7) surrounding the edges of the outer opening 114 is in close contact with the rear surface of the door body 121. Specifically, the outer gasket 31 is in close contact with the edges of the door liner 122, thereby blocking leakage air from within the entrance refrigerator 10, including hot air or cold air.

In addition, the hinge 124 is mounted on one surface of the door body 121 (or one surface of the outer door), and a latch recess 123 may be provided on the other surface of the door body 121 (or the other surface of the outer door). A door latch is inserted into the latch recess 123 to maintain the outer door 12 in a locked state, and the door latch may be provided in a partition 7 partitioning the entrance refrigerator 10 and the entrance door 3.

Specifically, the door latch may be mounted in a horizontal direction on a side surface of the partition 7 facing the other side surface of the door body 121 and may be drawn out from the partition 7 or drawn into the partition 7.

Conversely, the door latch may be installed to be drawn in or out from the door body 121 and the latch recess may be provided on a side surface of the partition 7.

Figure 10:
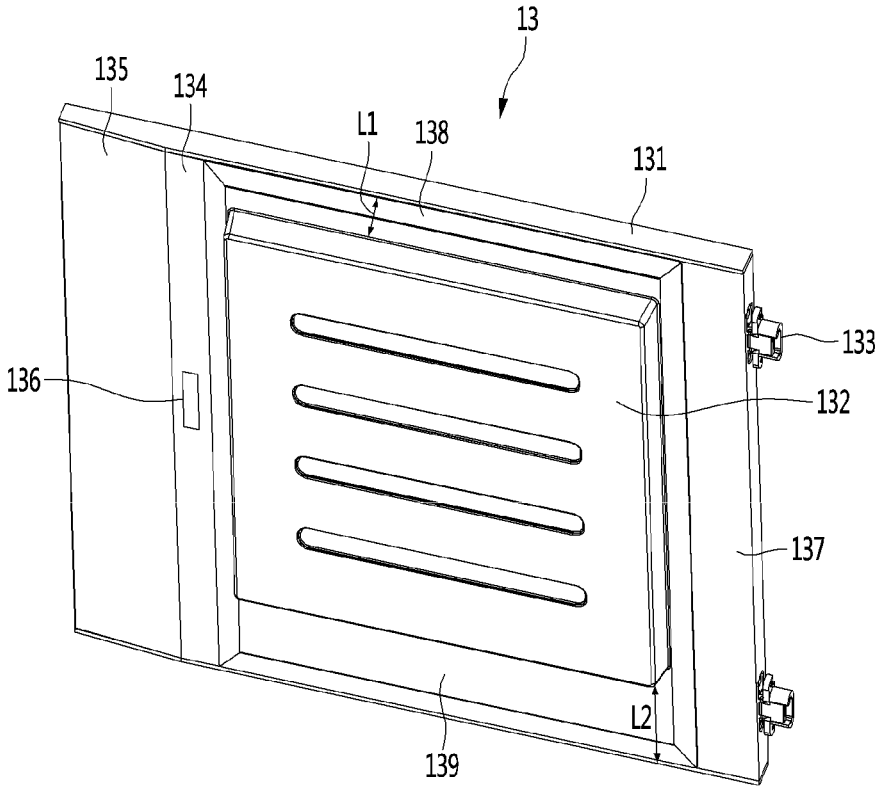
FIG. 10 is a rear perspective view of an inner door of an entrance refrigerator according to an embodiment of the present disclosure.

FIG. 10 is a rear perspective view of an inner door of the entrance refrigerator according to an embodiment of the present disclosure.

Referring to FIG. 10, the inner door 13 of the entrance refrigerator 10 according to an embodiment of the present disclosure may include a door body 131 and a door liner 132 provided on a rear surface of the door body 131.

Specifically, the door body 131 and the door liner 132 may be formed of a plastic material and may be filled with a heat insulating material therein. However, the door body 131 may be formed of a metal depending on design conditions.

The door liner 132 protrudes from the rear surface of the door body 131 by a predetermined thickness, and when the inner door 13 is closed, the door liner 132 is led into (e.g., positioned in) the storage compartment 101 through the inner opening 115.

In addition, when the inner door 13 is closed, the inner gasket 32 surrounding the edges of the inner opening 115 is in close contact with the rear surface of the door body 131 corresponding to the edges of the door liner 132.

A hinge 133 is mounted on one side (e.g., a first side) of the door body 131, and the hinge 133 may be fixed to the outer wall 2 or may be fixed to the cabinet 11. Since a front end of the cabinet 11 is embedded in the outer wall 2, the one side (e.g., first side) of the inner door 13, that is, the side on which the hinge 133 is mounted, may be spaced apart from the front end of the cabinet 11 by a predetermined distance (M: see FIG. 3).

In addition, the other side (e.g., second side) of the inner door 13 corresponding to the opposite side of the side on which the hinge 133 is mounted may be located at a rear side with respect to the rear end of the cabinet 11. That is, the side end portion defining the other side of the inner door 13 may extend further to a rear than a rear end of the cabinet 11 so as to be adjacent to the third storage 8. According to this structure, the components provided on the rear surface of the cabinet 11 including the heat dissipation cover 15, the drain pan 14, and the external air guide 16 are not exposed to the outside.

Specifically, a rear surface portion of the door body 131 may include a left rear surface portion from one side of the door body 131 to one side of the door liner 132, a right rear surface portion from the other side of the door body 131 to the other side of the door liner 132, an upper rear surface portion 138 from an upper end of the door body 131 to an upper end of the door liner 132, and a lower rear surface portion 139 from a lower end of the door body 131 to a lower end of the door liner 132.

In addition, the right rear surface portion may include a first right rear surface portion 134 in close contact with the side of the cabinet 11 when the inner door 13 is closed, and a second right rear surface portion 135 from the edge of the first right rear surface portion 134 to the other side of the door body 131.

A latch recess 136 may be formed at the first right rear surface portion 134, and a door latch may be provided in the cabinet 11 corresponding to the latch recess 136. That is, a locking device for locking the inner door 13 may be provided on the first right rear surface portion 134 and the cabinet 11 corresponding thereto.

The second right rear surface portion 135 is a portion extending further from the rear end of the cabinet 11 to the rear side, which serves to shield a space between the rear surface of the cabinet 11 and the third storage 8. That is, the second right rear surface portion 135 may extend from the first right rear surface portion 134.

In addition, a vertical width L1 of the second right rear surface portion 135 may be formed smaller than a vertical width L2 of the lower rear surface portion 139 (see FIG. 10).

This is because, as shown in FIG. 8, the length from the lower end of the side of the cabinet 11 to the lower end of the inner opening 115 is greater than a thickness of the cabinet 11.

The lower end of the inner opening 115 is formed higher than the bottom of the storage compartment 101, so that when the inner door 13 is opened, a phenomenon that cold air that stays on the bottom of the storage compartment 101 is leaked to the outside through the inner opening 115 may be minimized, thereby minimizing air leakage (e.g., loss of cold air).

In order to minimize the air leakage phenomenon (e.g., cold air leakage), the lower end of the inner opening 115 may also be designed higher than the bottom of the storage compartment 101.

Figure 11:
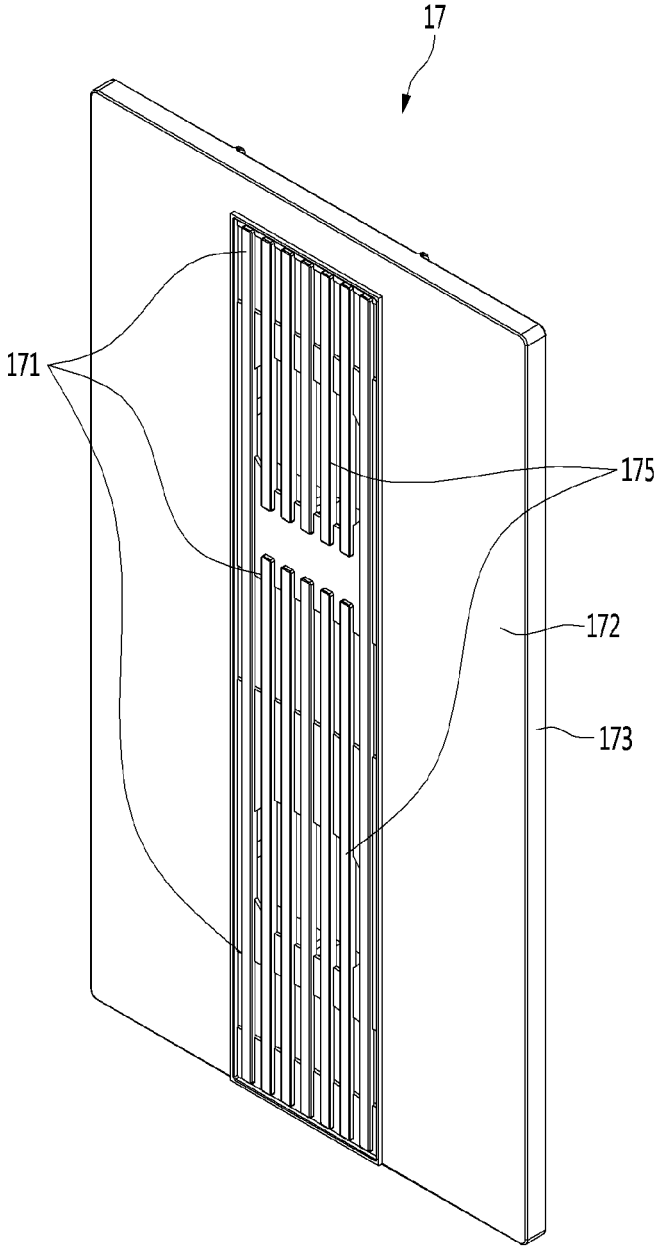
FIG. 11 is a front perspective view of a guide plate of an entrance refrigerator according to an embodiment of the present disclosure.
Figure 12:
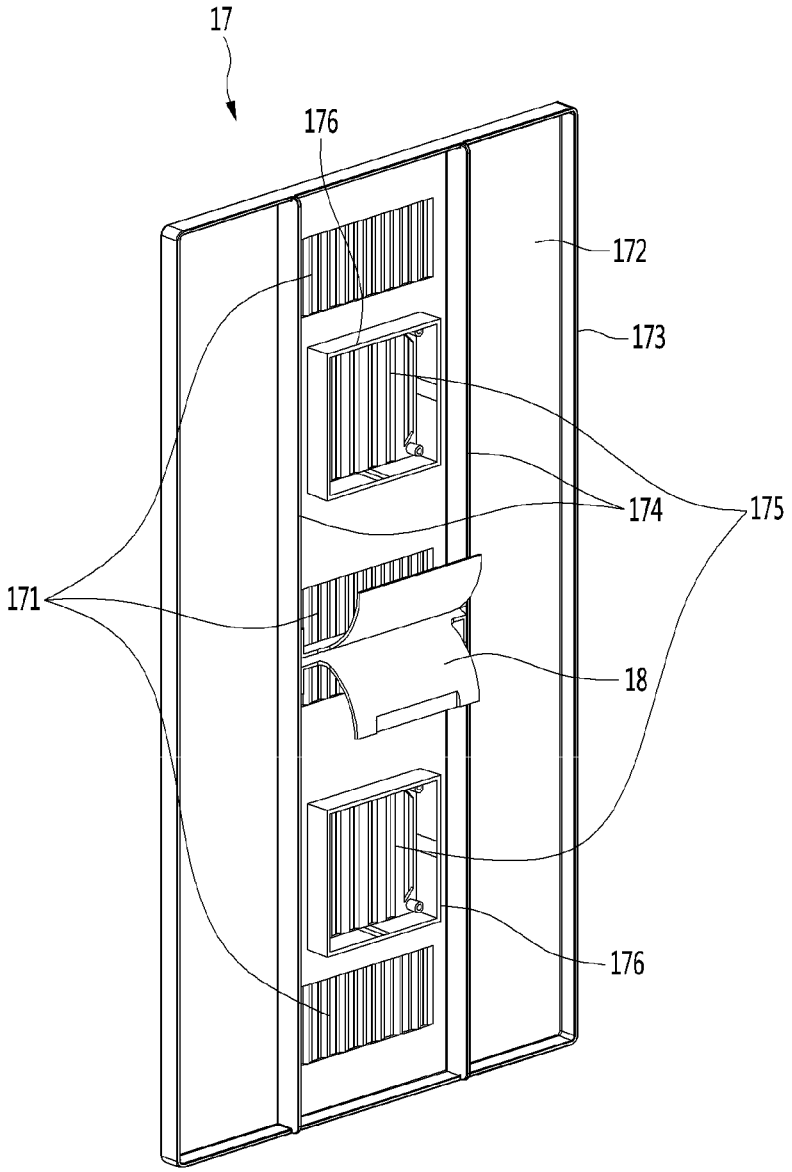
FIG. 12 is a rear perspective view of the guide plate.

FIG. 11 is a front perspective view of a guide plate of an entrance refrigerator according to an embodiment of the present disclosure, and FIG. 12 is a rear perspective view of the guide plate.

Referring to FIGS. 11 and 12, the guide plate 17 according to an embodiment of the present disclosure may include a plate body 172 having a rectangular shape, a bent portion 173 bent backward (e.g., extending backward or rearward) along the edges of the plate body 172, and at least a pair of reinforcing ribs 174 protruding from a rear surface of the plate body 172 and extending from an upper end of the plate body 172 to a lower end thereof. The bent portion 173 is in close contact with an inner surface of the inner case 112.

Further, a distance from a left edge of the plate body 172 to one of the pair of reinforcing ribs 174 may be equal to a distance from a right edge of the plate body 172 to the other of the pair of reinforcing ribs 174.

In addition, a plurality of grilles may be arranged to be spaced apart from each other in an up-down direction, i.e., in a lengthwise direction of the plate body 171, on the plate body 172 corresponding to between the pair of reinforcing ribs 174.

The grilles may be a structure including an opening formed at the plate body 172 and a plurality of vertical ribs formed in the opening. The plurality of vertical ribs may be spaced apart from each other in a widthwise direction of the opening that defines the grilles.

The plurality of grilles may include a plurality of discharge grilles 171 formed at a central portion of the plate body 172, an upper edge portion of the plate body 172, and a lower edge portion of the plate body 172, and a plurality of intake grilles 175 formed between the vertically adjacent discharge grilles 171.

The plurality of discharge grilles 171 may include an upper discharge grille formed near the upper edge of the plate body 172, a central discharge grille formed at the center of the plate body 172, and a lower discharge grille formed near the lower edge of the plate body 172.

In addition, a vertical length of the opening defining the central discharge grille may be designed to be twice a vertical length of the opening that defines the upper discharge grille, and a vertical length of the opening that defines the upper discharge grille may be designed to be equal to a vertical length of the opening that defines the lower discharge grille.

The plurality of intake grilles 175 may include an upper intake grille formed between the upper discharge grille and the central discharge grille and a lower intake grille formed between the central discharge grille and the lower discharge grille. The upper intake grille and the lower intake grille may be designed to have the same size or may have different sizes.

The heat absorption fan 23 of the cold air supply module 20 may be disposed on the rear side of the plurality of intake grilles 175.

A support rib 176 extends along the edge of the opening that defines the intake grille 175 to form a rectangular fan accommodating portion. Further, the support rib 176 may extend along an entire periphery of the edge of the opening that defines the intake grille 175 to form the rectangular fan accommodating portion. In addition, a portion of a front surface of the heat absorption fan 23 is accommodated in the fan accommodating portion defined by the support rib 176.

In addition, the inner air guide 18 may be mounted on a rear surface of the plate body 172 corresponding to (e.g., at, positioned on) the center of the central discharge grille. When the heat absorption fan 23 is driven, cold air of the storage compartment 101 is introduced into the cold air generating compartment 102 through the upper intake grille and the lower intake grille to hit (e.g., contact) the surface of the cold sink 22.

The cold air that hits the cold sink 22 is lowered in temperature through heat exchange and then dividedly flow in an up-down direction of the cold sink 22. A part of the cold air flowing in the up-down direction of the cold sink 22 flows back into the storage compartment 101 through the upper discharge grille and the lower discharge grille.

Additionally, cold air flowing along the inner air guide 18 is introduced back into the storage compartment 101 through the central discharge grille.

Here, intake and discharge flow paths of the cold air may be reversed according to types of the heat absorption fan 23, in which case the intake grilles may function as discharge grilles and the discharge grilles may function as intake grilles.

Figure 13:
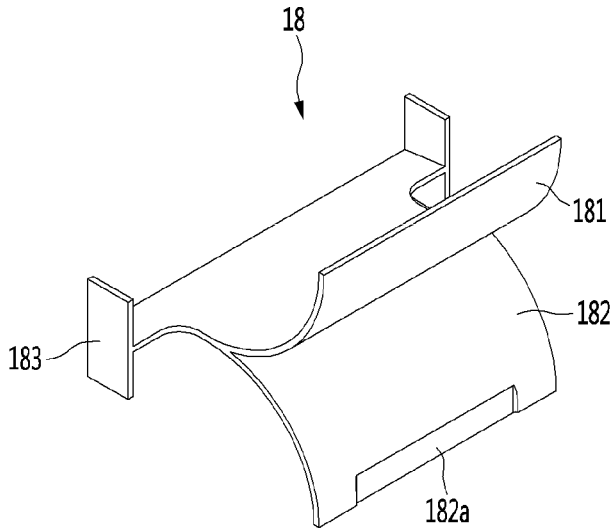
FIG. 13 is a rear perspective view of an inner air guide of an entrance refrigerator according to an embodiment of the present disclosure.

FIG. 13 is a rear perspective view of the inner air guide of an entrance refrigerator according to an embodiment of the present disclosure.

Referring to FIG. 13, the inner air guide 18 according to an embodiment of the present disclosure may include an upper guide 181 extending to be rounded upward (e.g., curved upwards) from a front end toward a rear end, a lower guide 182 extending to be rounded downward (e.g., curved downwards) from the front end toward the rear end thereof, and a flange 183 extending vertically from the side of the front end where the upper guide 181 and the lower guide 182 meet. The front end (e.g., base) where the upper guide 181 and the lower guide 182 meet may be substantially planar and may extend in a horizontal direction. Further, the upper guide 181 and the lower guide 182 may be symmetric about the front end where the upper guide 181 and the lower guide 182 meet.

The front end of the upper guide 181 may meet the front end of the lower guide 182 to form a single body. That is, the inner air guide 18 may be formed of a singular unitary body having an upper guide 181 and a lower guide 182, the upper guide 181 and the lower guide 182 meet at a single point, and the upper guide 181 and the lower guide 182 may be curved in opposite directions from the single point.

The upper guide 181 and the lower guide 182 may be rounded or inclined in a vertically symmetrical shape with respect to a horizontal surface where front ends of the upper guide 181 and the lower guide 182 meet, i.e., a horizontal surface that vertically bisects the inner air guide 18.

Specifically, the upper guide 181 may be rounded in a direction in which a slope of a tangent passing through a rear surface of the upper guide 181 increases from the front end toward the rear end.

Alternatively, the upper guide 181 and the lower guide 182 may be inclined at the same angle to an upper side and a lower side from the horizontal plane, the upper guide 181 and the lower guide 182 meeting (e.g., adjoining) at the horizontal plane, and the horizontal plane bisects the inner air guide 18 vertically (e.g., in an up and down direction).

Here, the rear surface of the upper guide 181 and the rear surface of the lower guide 182 may refer to two surfaces facing each other (or extending away from each other, as shown in FIG. 13), and the opposite surfaces of the rear surfaces may be defined as a front surface of the upper guide 181 and a front surface of the lower guide 182, respectively.

The flange 183 extends from the left and right ends of the upper guide 181 and the lower guide 182 and is coupled to the pair of reinforcing ribs 174 formed on the rear surface of the guide plate 17.

Specifically, the front end of the inner air guide 18 may be disposed at a point that bisects the central discharge grille of the guide plate 17 up and down. Accordingly, cold air forcedly flowing by the upper heat absorption fan 23 and cold air forcedly flowing by the lower heat absorption fan 23 are discharged to the storage compartment 101 substantially uniformly through the central discharge grille.

In addition, the flange 183 may be fixedly mounted to the reinforcing rib 174 by a screw or other fastener passing through the reinforcing rib 174. Alternatively, the flange 183 may be attached to the reinforcing rib 174 by an adhesive member, brazing, welding or any other joining method.

Alternatively, the flange 183 may not be provided, and the front ends where the upper guide 181 and the lower guide 182 meet may be attached directly to the rear surface of the guide plate 17, such as by fastening with fasteners, adhesive bonding, brazing or welding.

In addition, a rear end of the upper surface of the lower guide 182 may be provided with an interference preventing recess 182*a*, and a function of the interference preventing recess 182*a* will be described in detail with reference to the drawings below. The interference preventing recess 182*a* is provided at a rear end of the lower guide 182, opposite to the front end where the upper guide 181 meets the front end of the lower guide 182. Further, the interference preventing recess 182*a* may extend substantially an entire width of the rear end of the lower guide 182, or may extend less than an entire width of the rear end of the lower guide 182.

Figure 14:
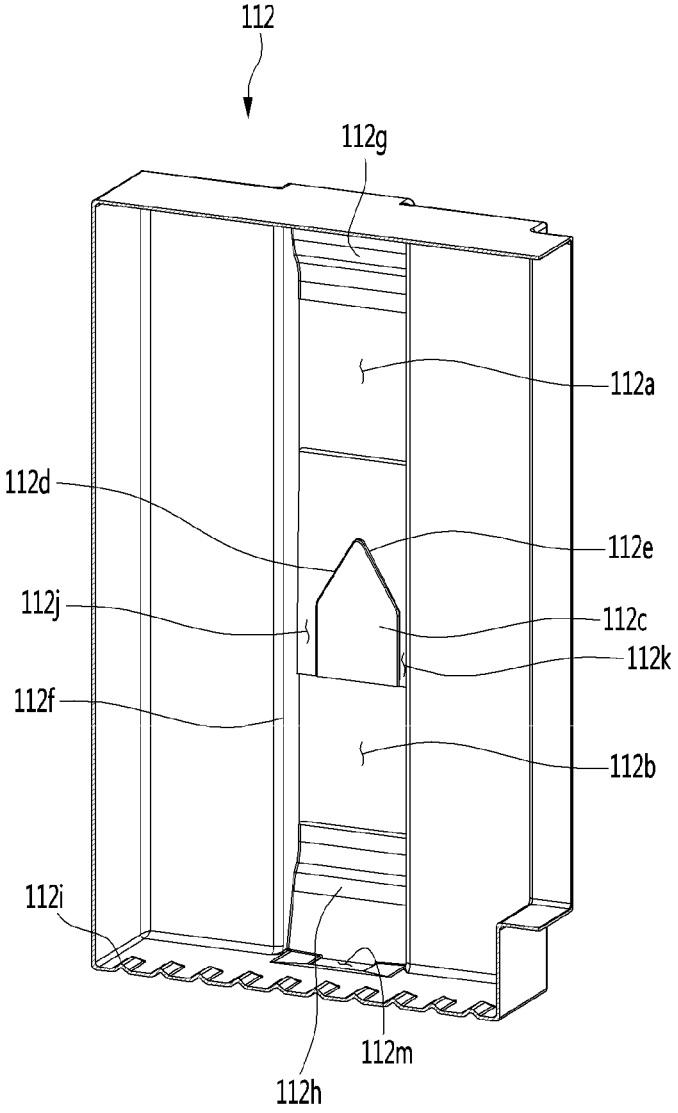
FIG. 14 is a cutaway perspective view showing a rear wall of an inner case of a cabinet of an entrance refrigerator according to an embodiment of the present disclosure.
Figure 15:
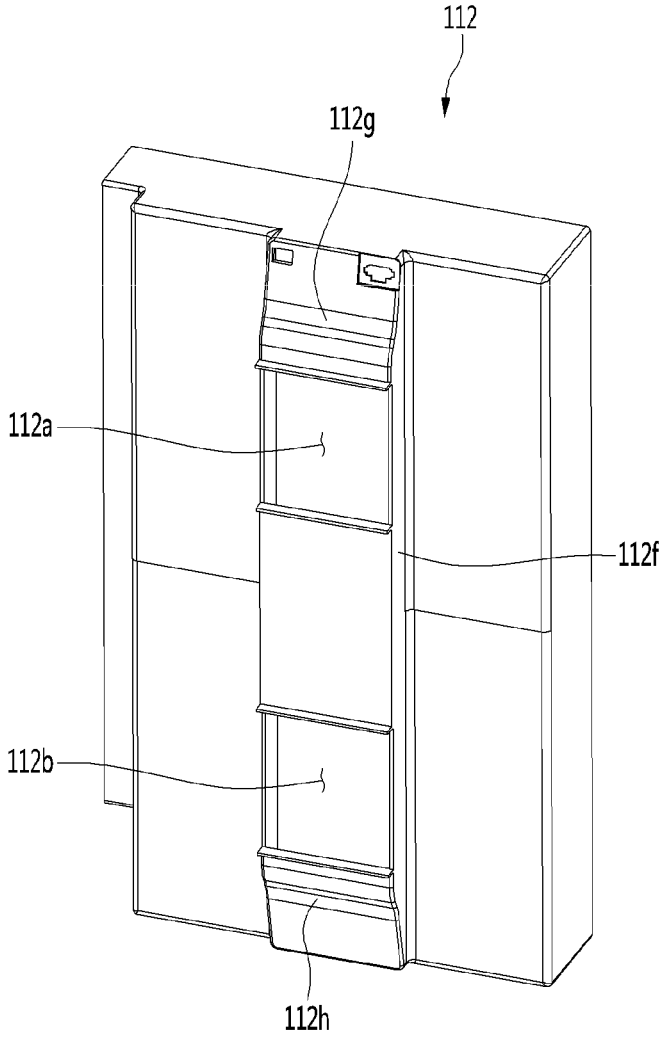
FIG. 15 is a rear perspective view of a rear wall of the inner case.

FIG. 14 is a cutaway perspective view showing a rear wall of an inner case of a cabinet of an entrance refrigerator according to an embodiment of the present disclosure, and FIG. 15 is a rear perspective view of the rear wall of the inner case.

Referring to FIGS. 14 and 15, a through-hole in which one or a plurality of cold air supply modules 20 are mounted is provided on a rear wall of the inner case 112 of the cabinet 11 of the entrance refrigerator 10 according to an embodiment of the present disclosure.

Specifically, in a case where a pair of cold air supply modules 20 are mounted on the rear wall/surface of the cabinet 11, an upper through-hole 112*a* and a lower through-hole 112*b* may be provided on the rear wall of the cabinet 11.

At the center of the rear wall of the inner case 112, a center recess 112*f* having a predetermined width may be provided to extend from an upper end of the rear wall of the inner case 112 to a lower end of the inner case 112 (e.g., the center recess 112*f* extend an entire distance from an upper end of the rear wall of the inner case 112 to a lower end of the inner case 112). The center recess 112*f* may be a portion of the rear wall of the inner case 112, which is recessed or stepped backward, and may be formed by a forming process, such as a deforming process (e.g., pressing, molding, etc.).

An upper end of the upper through-hole 112*a* is spaced apart by a predetermined distance downward (e.g., is spaced downward from) from an upper end of the center recess 112*f*, and a lower end of the lower through-hole 112*b* is spaced apart by a predetermined distance upward (e.g., is spaced upward from) from a lower end of the center recess 112*f*.

Further, on the rear wall of the inner case 112 defining the center recess 112*f*, an upper guide portion 112*g* rounded in a direction protruding rearward or stepped a plurality of times in a stairway (e.g., stair-like or stair) shape from the upper end of the center recess 112*f* toward the upper end of the upper through-hole 112*a* is defined.

In the same manner, a lower guide portion 112*h* is provided at a portion from the lower end of the center recess 112*f* to the lower end of the lower through-hole 112*b*.

The upper guide portion 112*g* and the lower guide portion 112*h* may be understood as portions provided to guide a flow of air pulled in by the intake fan 23 and ascends or descends along the cold sink 22 toward the discharge grille 171 of the guide plate 17.

Therefore, when the upper guide portion 112*g* and the lower guide portion 112*h* are designed to be smoothly rounded toward the front of the inner case 112, flow resistance that may occur in the process of guiding air cooled while passing through the cold sink 22 to the storage compartment 101 may be minimized.

Additionally, a guide protrusion 112*c* may be provided for guiding a flow of condensate water, and the guide protrusion 112*c* may protrude from the rear wall of the inner case 112 corresponding to between the upper through-hole 112*a* and the lower through-hole 112*b*.

Specifically, the guide protrusion 112*c* may be formed to have a width narrower toward the upper through-hole 112*a*. Specifically, the guide protrusion 112*c* includes a left inclined portion 112*d* and a right inclined portion 112*e*, and an upper end of the left inclined portion 112*d* and an upper end of the right inclined portion 112*e* meet to form a peak. That is, the guide protrusion 112*c* may form a triangular shape with the left inclined portion 112*d* and the right inclined portion 112*e*.

In addition, the left inclined portion 112*d* and the right inclined portion 112*e* may extend from a point where they are spaced apart upward from the lower through-hole 112*b*. In other words, the guide protrusion 112*c* may extend vertically upward with a predetermined width from the upper end of the lower through-hole 112*b* and extend to have a narrower width, starting from a point where the left inclined portion 112*d* and the right inclined portion 112*e* are formed (e.g., begin).

By this structure, condensate water or defrost water flowing down the surface of the cold sink 22 of the cold air supply module 20 mounted at the upper through-hole 112*a* flows down to the bottom of the inner case 112 along a left edge and a right edge of the guide protrusion 112*c*.

Specifically, the condensate water or the defrost water flows down to the bottom of the inner case 112 along a left flow path 112*j* formed at a left edge of the center recess 112*f* and a left edge of the guide protrusion 112*c* and a right flow path 112*k* formed at a right edge of the center recess 112*f* and a right edge of the guide protrusion 112*c*.

Here, the condensate water or the defrost water flowing down to the upper end of the guide protrusion 112*c* is divided at the left inclined portion 112*d* and the right inclined portion 112*e* to flow to the left flow path 112*j* and the right flow path 112*k*.

In addition, a drain hole 112*m* is formed at a point where the rear wall and the bottom surface of the inner case 112 meet, and one end of the drain hose 141 is connected to the drain hole 112*m*. Therefore, the condensate water or the defrost water flowing down to the bottom of the inner case 112 is collected to the drain pan 14 along the drain hose 141.

As another example, the left inclined portion 112*d* and the right inclined portion 112*e* may extend from the upper end of the lower through-hole 112*b*, so that the guide protrusion 112*c* may have a triangular protrusion shape.

Thus, by allowing the condensate water or the defrost water flowing from the upper cold sink 22 to flow along both side ends of the cold sink of the cold air supply module 20, a phenomenon that cold air forcedly flowing by the heat absorption fan 23 acts as flow resistance to the condensate water may be minimized.

Specifically, cold air introduced into the cold air generating compartment 102 from the storage compartment 101 by the heat absorption fan 23 (e.g., by being pulled by the heat absorption fan 23) directly hits (e.g., contacts) the front surface of the cold sink 22 and then dividedly flows to the upper side and the lower side. In addition, a flow rate of the cold air hitting the front surface of the cold sink 22 is relatively low from the center of the front surface of the cold sink 22 toward the both side ends.

Therefore, a flow resistance may occur as the cold air ascending after hitting the surface of the cold sink of the cold air supply module 20 mounted in the lower through-hole 112*b* pushes up the condensate water or the defrost water flowing down from the upper cold sink 22.

Here, the flow resistance acting on the condensate water or the defrost water that flows down may be minimized by dispersing the flow of the condensate water or the defrost water to the left flow path 112*j* and the right flow path 112*k*.

Figure 16:
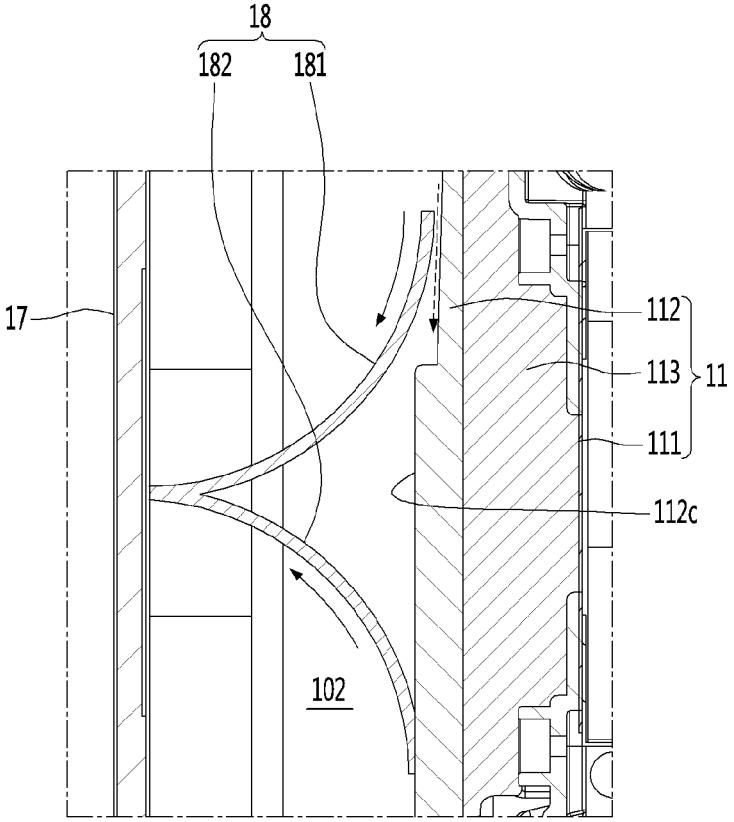
FIG. 16 is an enlarged cross-sectional view of a portion A of FIG. 7.

FIG. 16 is an enlarged cross-sectional view of part A of FIG. 7.

Referring to FIG. 16, as indicated by the solid arrows, when the heat absorption fan (upper heat absorption fan) of the first cold air supply module and the heat absorption fan (lower heat absorption fan) of the second cold air supply module are driven, cold air (e.g., intake air) of the storage compartment 101 is pulled into the cold air generating compartment 102 through the guide plate 17.

The cold air pulled into the cold air generating compartment 102 is changed in a flow direction by 180 degrees by the upper guide 181 and the lower guide 182. That is, the cold air pulled by the heat absorption fans hits the front surface of the sink body of the cold sink 22 and descends, and then is dispersed up and down.

The cold air dispersed up and down is changed in flow direction toward the storage compartment by the upper guide 181 and the lower guide 182. The cold air changed in flow direction is discharged to the storage compartment 101 through the guide plate 17.

Additionally, a rear end of the upper guide 181 of the inner air guide 18 is spaced apart from the rear wall of the inner case 112 defining the center recess 112*f* This is to prevent the flow of the condensate water or the defrost water flowing down along the rear wall of the inner case 112 as indicated by the dotted arrow from being interfered by the upper guide 181.

If the rear end of the upper guide 181 is in contact with the rear wall of the inner case 112, the condensate water or the defrost water moves to the front end of the upper guide 181 along the upper surface of the upper guide 181. In addition, the condensate water or the defrost water flowing along the upper surface of the upper guide 181 flows down to the bottom of the storage compartment 101 along the guide plate 17. Then, the condensate water flowing down to the bottom of the inner case 112 does not flow toward the drain hole 112*m* formed at the bottom of the cold air generating compartment 102 but remains at the bottom of the storage compartment 101. This phenomenon may cause mold to occur inside the storage compartment 101 and to cause odor.

Additionally, the rear end of the lower guide 182 may be in contact with the guide protrusion 112*c*, and the interference preventing recess 182*a* formed on the upper surface of the rear end of the lower guide 182 may be defined as a recess accommodating the guide protrusion 112*c*. Therefore, a width of the interference preventing recess 182*a* may be formed to have a size corresponding to the width of the guide protrusion 112*c*.

Of course, the left edge and the right edge of the rear end of the lower guide 182 are spaced apart from the rear wall of the inner case 112 defining the left flow path 112*j* and the right flow path 112*k*.

Additionally, the front surface of the rear wall of the inner case 112 from the lower end of the upper through-hole 112*a* and the upper end of the lower through-hole 112*b* may be formed to be inclined in the form of protruding forward toward a lower side (e.g., inclined toward a lower side). The inclined structure may also be applied to the rear wall of the inner case 112 defining the left flow path 112*j* and the right flow path 112*k* in the same manner.

The inclined structure may minimize a phenomenon that the condensate water or the defrost water falling from the cold sink 22 of the first cold air supply module 20 hits directly the cold sink 22 of the second cold air supply module 20 and scatters.

That is, by allowing the condensate water or the defrost water to flow along the inclined rear wall of the inner case 112 to reach the surface of the cold sink 22 of the second cold air supply module 20, scattering of the condensate water may be minimized.

Figure 17:
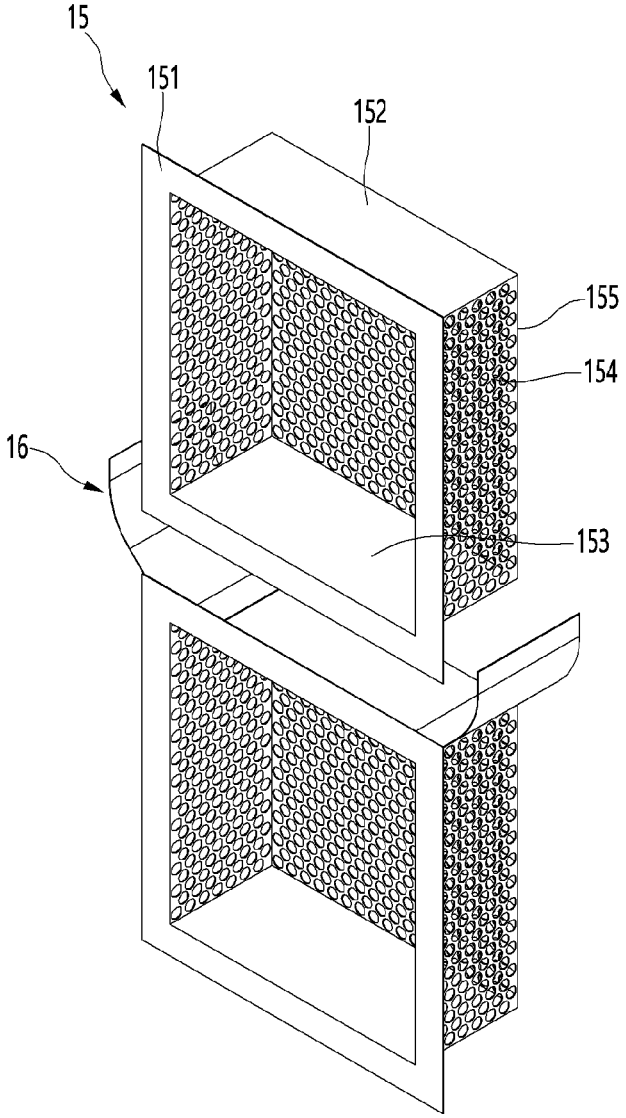
FIG. 17 is a front perspective view of a heat dissipation cover and an external air guide according to an embodiment of the present disclosure.
Figure 18:
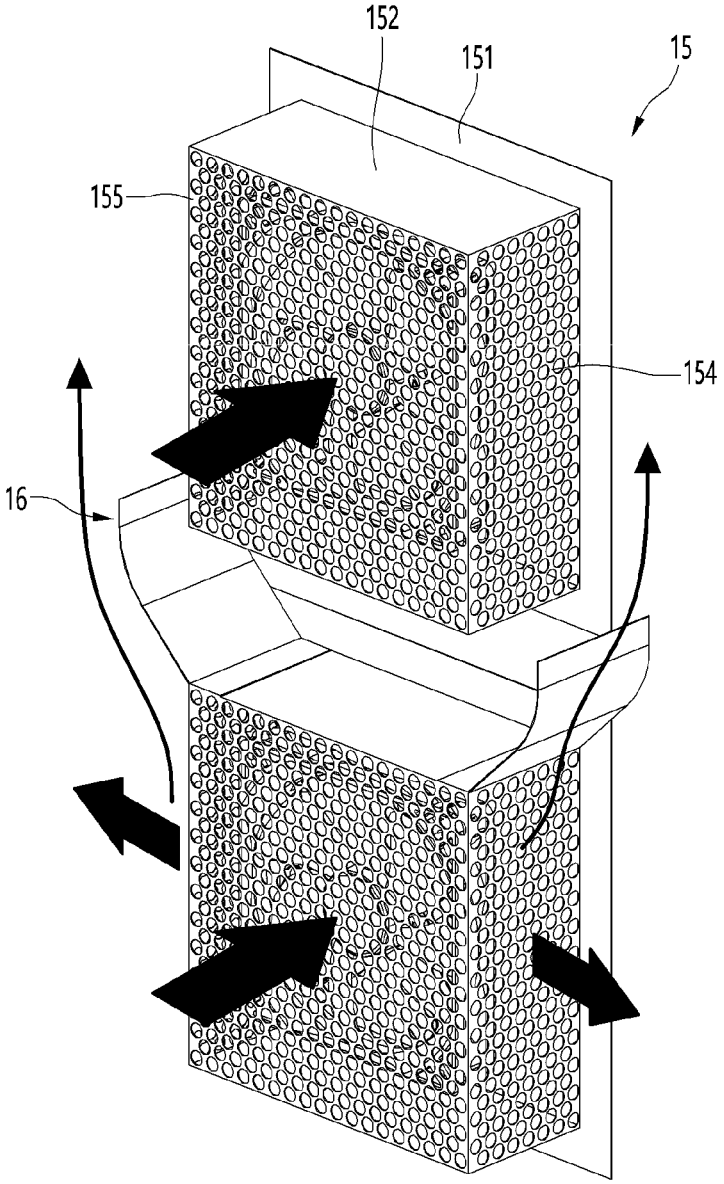
FIG. 18 is a rear perspective view of the heat dissipation cover and the external air guide.

FIG. 17 is a front perspective view of a heat dissipation cover 15 and an external air guide 16 according to an embodiment of the present disclosure, and FIG. 18 is a rear perspective view of the heat dissipation cover 15 and the external air guide 16.

Referring to FIGS. 17 and 18 together with FIG. 7, the heat dissipation cover 15 according to an embodiment of the present disclosure may have a hexahedral (e.g., hexahedron) shape or any shape with an open front surface.

Specifically, the heat dissipation cover 15 may include a cover body opened at a front surface, and a flange 151 vertically bent and extended from a front end of the cover body. The flange 151 is coupled to the rear surface of the cabinet 11.

The cover body includes an upper surface portion 152, a lower surface portion 153, a rear surface portion 155, and a side surface portion 154. The side surface portion 154 includes a left side surface portion and a right side surface portion.

More specifically, the upper surface portion 152, the side surface portion 154, and the lower surface portion 153 have a predetermined width and extend in a quadrangular band shape, and the rear surface portion 155 may be defined as a vertical plane connecting rear ends of the upper surface portion 152, the side surface portion 154, and the lower surface portion 153.

In addition, a plurality of heat dissipation holes may be provided in the side surface portion 154 and the rear surface portion 155 except for the upper surface portion 152 and the lower surface portion 153. Accordingly, when the heat dissipation fan 25 is rotated (e.g., operated), external air flows into the cold air supply module 20 through the plurality of heat dissipation holes formed in the rear surface portion 155. The external air flowing into the cold air supply module 20 is heat-exchanged with the heat sink 24 and is subsequently discharged to the outside again through the side surface portion 154.

Since a plurality of heat exchange fins of the heat sink 24 extend in a left-right direction in a horizontal state and are spaced apart from each other in an up-down direction, the external air pulled in by the heat dissipation fan 25 flows dividedly to the left side and the right side of the heat dissipation cover 15.

In addition, in the case of the entrance refrigerator 10 in which the pair of cold air supply modules 20 are disposed up and down (e.g., the pair of cold air supply modules 20 are spaced apart in a vertical direction, as shown in FIGS. 4, 5 and 7), it is necessary to minimize a phenomenon that heat emitted from the lower heat dissipation cover reflows to the upper heat dissipation cover.

The upper surface portion 152 and the lower surface portion 153 of the heat dissipation cover 15 may be formed in a plate shape (e.g., planar shape) in which a heat dissipation hole is not formed (e.g., provided without heat dissipation holes). Specifically, it is sufficient that only the upper surface portion of the lower heat dissipation cover and the lower surface portion of the upper heat dissipation cover are designed not to have any heat dissipation holes. However, in order to ensure compatibility of components, both the upper surface portion 152 and the lower surface portion 153 of the heat dissipation cover 15 may be formed in a plate shape without heat dissipation holes.

Additionally, the external air guide 16 may be mounted between the upper heat dissipation cover and the lower heat dissipation cover, and a specific structure of the external air guide 16 will be described with reference to the drawings below.

Figure 19:
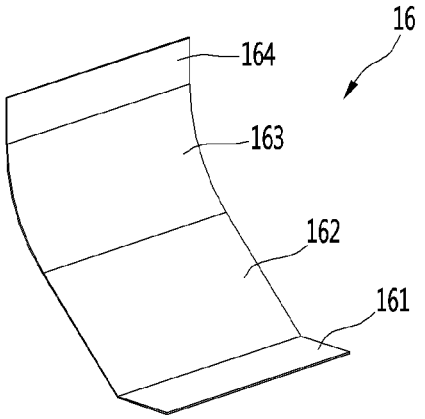
FIG. 19 is a perspective view of an external air guide according to an embodiment of the present disclosure.

FIG. 19 is a perspective view of an external air guide 16 according to an embodiment of the present disclosure.

Referring to FIG. 19, the external air guide 16 according to an embodiment of the present disclosure may be coupled in a wing shape to the upper surface portion 152 of the lower heat dissipation cover 15.

Specifically, the external air guide 16 may be coupled to each of left and right edges of the upper surface portion 152 of the lower heat dissipation cover 15 and may extend past the left and right edges of the upper surface portion 152 of the lower heat dissipation cover 15 (e.g., the external air guide 16 may have a greater width than the upper surface portion 152).

The external air guide 16 may include at least one of a base 161 seated on the upper surface portion 152, an inclined portion 162 extending inclined upward from one side end of the base 161, a rounded portion 163 rounded upward from one side end of the inclined portion 162, and a vertical portion 164 extending vertically from one side end of the rounded portion 163.

In other words, the external air guide 16 may have one shape of a first structure including only the base 161 and the inclined portion 162, a second structure obtained by adding the rounded portion 163 to the first structure, a third structure obtained by adding the vertical portion 164 to the first structure, and a fourth structure (shape shown in FIGS. 19 and 20) obtained by adding the vertical portion 164 to the second structure.

The base 161 may be fixed to the upper surface portion 152 in various shapes including thermosetting, welding, bolt assembling, and the like.

In addition, the upper end of the external air guide 16 may extend to a position higher than the lower surface portion of the upper heat dissipation cover 15.

In the drawing, the upper end of the external air guide 16 is shown to extend to a point lower than the middle of the upper heat dissipation cover 15 but is not limited thereto. For example, an upper end of the external air guide 16 may be equal to or higher than the upper surface portion 152 of the upper heat dissipation cover 15.

As the height of the upper end of the external air guide 16 is higher, it is possible to minimize a possibility that heat emitted from the lower heat dissipation cover is re-introduced into the upper heat dissipation cover. In addition, heat emitted to both sides of the lower heat dissipation cover may rise along a lower surface of the external air guide 16 and, at the same time, heat emitted to both sides of the upper heat dissipation cover may be guided upward along an upper surface of the external air guide 16. To this end, the external air guide 16 preferably extends to be spaced apart from the side surface portion of the upper heat dissipation cover.

In addition, the external air guide 16 may extend upward from the left edge and the right edge of the lower surface portion of the upper heat dissipation cover.

Figure 20:
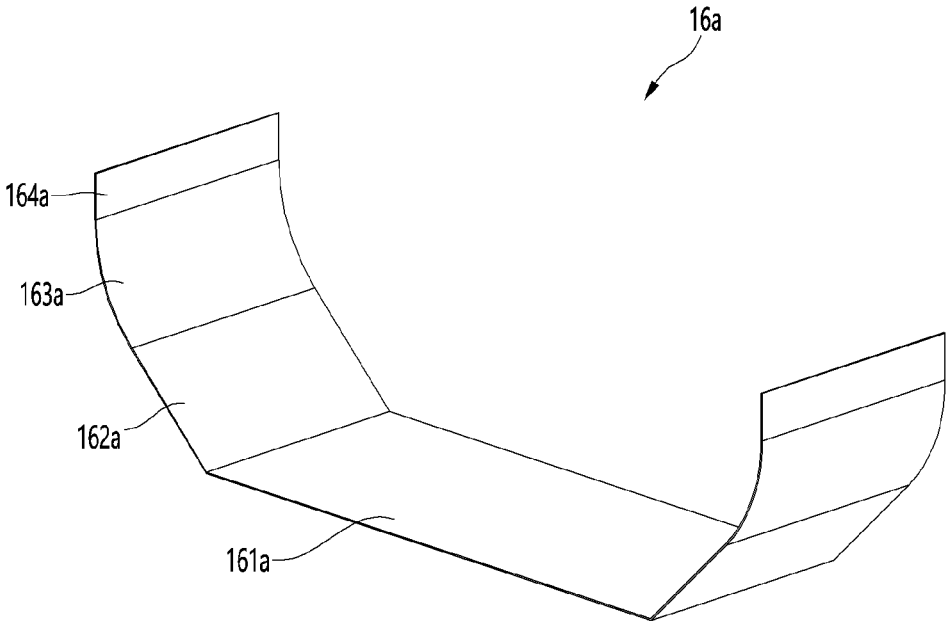
FIG. 20 is a perspective view of an external air guide according to another embodiment of the present disclosure.

FIG. 20 is a perspective view of an external air guide **16*a*** according to another embodiment of the present disclosure.

Referring to FIG. 20, an external air guide **16*a* may include a base 161*a* having a length corresponding to a horizontal length of the upper surface portion 152, and extending portions extending upward from a left end and a right end of the base 161*a***.

Specifically, similarly to that shown in FIG. 19, the extending portion may include at least one of an inclined portion **162*a*, a rounded portion 163*a*, and a vertical portion 164*a*. For example, the extending portion may include one of a first structure including only the inclined portion 162*a*, a second structure including only the rounded portion 163*a*, a third structure including the inclined portion 162*a* and the rounded portion 163*a*, a fourth structure including the inclined portion 162*a* and the vertical portion 164*a*, and a fifth structure including all the inclined portion 162*a*, the rounded portion 163*a*, and the vertical portion 164*a***.

In addition, an extending portion extending from a left edge of the base **161*a* may be defined as a left extending portion and an extending portion extending from a right edge of the base 161*a*** may be defined as a right extending portion. The left extending portion and the right extending portion may be symmetrical with respect to a vertical plane.

Upper ends of the left and right extending portions may extend to a point between the lower surface portion 153 and the upper surface portion 152 of the upper heat dissipation cover or may extend to a point higher than the upper surface portion 152 of the upper heat dissipation cover as described in the former embodiment.

The external air guide **16*a* may also be coupled to the lower surface portion 153** of the upper heat dissipation cover.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An entrance refrigerator, comprising:

a cabinet, including:

a first surface having a first opening exposed to a first space;

a second surface having a second opening exposed to a second space; and a storage space, wherein the cabinet is configured to be embedded in an outer wall partitioning the first space and the second space;

a first door configured to selectively open and close the first opening;

a second door configured to selectively open and close the second opening;

a cold air supply assembly configured to supply cold air to the storage space, the cold air supply assembly including:

a first cold air supply mounted on an upper portion of a rear surface of the cabinet; and a second cold air supply mounted on a lower portion of the rear surface of the cabinet, wherein each of the first cold air supply and the second cold air supply includes:

a thermoelectric element including an endothermic surface on a first side of the thermoelectric element and an exothermic surface on a second side of the thermoelectric element, the first side of the thermoelectric element being opposite to the second side of the thermoelectric element;

a cold sink mounted on the endothermic surface of the thermoelectric element;

a heat absorption fan positioned in front of the cold sink;

a heat sink mounted on the exothermic surface of the thermoelectric element;

a heat dissipation fan disposed at a rear of the heat sink; and a heat insulation block surrounding edges of the thermoelectric element and disposed between the cold sink and the heat sink to block heat transfer between the cold sink and the heat sink;

a first heat dissipation cover covering the heat sink and the heat dissipation fan of the first cold air supply;

a second heat dissipation cover covering the heat sink and the heat dissipation fan of the second cold air supply; and an external air guide provided between the first heat dissipation cover and the second heat dissipation cover, and including at least one of an inclined portion and a rounded portion, in order to upwardly guide air discharged from the second heat dissipation cover, while minimizing inflow of the air discharged from the second heat dissipation cover into the first heat dissipation cover.

2. The entrance refrigerator of claim 1, wherein the heat sink includes:

a sink body having a front surface attached to the exothermic surface of the thermoelectric element; and a plurality of heat exchange fins arranged on a rear surface of the sink body.

3. The entrance refrigerator of claim 1, wherein each of the first heat dissipation cover and the second heat dissipation cover includes:

a cover body having an open front side, the cover body having an interior space covering the heat sink and the heat dissipation fan, wherein at least a portion of the cover body includes a plurality of heat dissipation holes allowing external air to flow in and out of the cover body; and a flange extending from the cover body at an edge of the front side of the cover body and in contact with the rear surface of the cabinet.

4. The entrance refrigerator of claim 3, wherein each cover body has a hexahedron shape having an upper surface portion, a lower surface portion, a left surface portion, a right surface portion, and a rear surface portion, wherein the upper surface portion is spaced from the lower surface portion in a vertical direction, wherein the left surface portion is spaced from the right surface portion in a horizontal direction, and wherein the plurality of heat dissipation holes are provided in the left surface portion, the right surface portion, and the rear surface portion.

5. The entrance refrigerator of claim 4, wherein the external air guide is coupled to the upper surface portion of the second heat dissipation cover or the lower surface portion of the first heat dissipation cover, and wherein the external air guide is symmetric about a horizontal center of at least one of the first heat dissipation cover and the second heat dissipation cover.

6. The entrance refrigerator of claim 4, wherein the external air guide extends past the left surface portion and the right surface portion of the first heat dissipation cover in the horizontal direction and extends in the vertical direction.

7. The entrance refrigerator of claim 6, wherein the external air guide further includes a base coupled to the upper surface portion of the second heat dissipation cover or the lower surface portion of the first heat dissipation cover, and wherein at least one of the inclined portion and the rounded portion extends from a first side of the base.

8. The entrance refrigerator of claim 7, wherein the external air guide includes both the inclined portion and the rounded portion, wherein the inclined portion extends from a first side of the base, wherein the rounded portion extends from the inclined portion, and wherein the external air guide further includes a vertical portion extending from the rounded portion in the vertical direction.

9. The entrance refrigerator of claim 4, wherein the external air guides includes:

a base coupled to an upper surface portion of the second heat dissipation cover or a lower surface portion of the first heat dissipation cover, the base including a first end and a second end, the first end being spaced apart from the second end in the horizontal direction;

a first extending portion extending from the first end of the base; and a second extending portion extending from the second end of the base, and wherein the external air guide is symmetric about a horizontal center of at least one of the first heat dissipation cover and the second heat dissipation cover.

10. The entrance refrigerator of claim 9, wherein the first end of the base is aligned with a left end of the upper surface portion of the second heat dissipation cover or a left end of the lower surface portion of the first heat dissipation cover, wherein the second end of the base is aligned with a right end of the upper surface portion of the second heat dissipation cover or a right end of the lower surface portion of the first heat dissipation cover, and wherein the at least one of the rounded portion and the inclined portion is formed at each of the first extending portion and the second extending portion.

11. The entrance refrigerator of claim 10, wherein each of the first extending portion and the second extending portion further includes a vertical portion extending from the at least one of the rounded portion and the inclined portion in the vertical direction.

12. The entrance refrigerator of claim 4, wherein the external air guide is provided on the upper surface portion of the second heat dissipation cover, and wherein an upper end of the external air guide is higher than the lower surface portion of the first heat dissipation cover and is lower than the upper surface portion of the first heat dissipation cover.

13. An entrance refrigerator, comprising:

a cabinet including a storage space, wherein the cabinet is configured to be embedded in an outer wall partitioning a first space and a second space;

a cold air supply assembly configured to supply cold air to the storage space, the cold air supply assembly including:

a first cold air supply mounted on an upper portion of a rear surface of the cabinet; and a second cold air supply mounted on a lower portion of the rear surface of the cabinet, wherein each of the first cold air supply and the second cold air supply includes:

a thermoelectric element including an endothermic surface on a first side of the thermoelectric element and an exothermic surface on a second side of the thermoelectric element, the first side of the thermoelectric element being opposite to the second side of the thermoelectric element;

a cold sink mounted on the endothermic surface of the thermoelectric element;

a heat absorption fan positioned in front of the cold sink;

a heat sink mounted on the exothermic surface of the thermoelectric element; and a heat dissipation fan disposed at a rear of the heat sink;

a first heat dissipation cover covering the heat sink and the heat dissipation fan of the first cold air supply;

a second heat dissipation cover covering the heat sink and the heat dissipation fan of the second cold air supply; and an external air guide provided between the first heat dissipation cover and the second heat dissipation cover, and including at least one of an inclined portion and a rounded portion, in order to upwardly guide air discharged from the second heat dissipation cover, while minimizing inflow of the air discharged from the second heat dissipation cover into the first heat dissipation cover.

14. The entrance refrigerator of claim 13, wherein each of the first heat dissipation cover and the second heat dissipation cover includes:

a cover body having an open front side, the cover body having an interior space covering the heat sink and the heat dissipation fan, wherein at least a portion of the cover body includes a plurality of heat dissipation holes allowing external air to flow in and out of the cover body; and a flange extending from the cover body at an edge of the front side of the cover body and in contact with the rear surface of the cabinet.

15. The entrance refrigerator of claim 14, wherein each cover body has a hexahedron shape having an upper surface portion, a lower surface portion, a left surface portion, a right surface portion, and a rear surface portion, wherein the upper surface portion is spaced from the lower surface portion in a vertical direction, wherein the left surface portion is spaced from the right surface portion in a horizontal direction, and wherein the plurality of heat dissipation holes are provided in the left surface portion, the right surface portion, and the rear surface portion.

16. The entrance refrigerator of claim 15, wherein the external air guide is coupled to the upper surface portion of the second heat dissipation cover, and wherein the external air guide is symmetric about a horizontal center of at least one of the first heat dissipation cover and the second heat dissipation cover.

17. The entrance refrigerator of claim 16, wherein the external air guide extends past the left surface portion and the right surface portion of the first heat dissipation cover in the horizontal direction, and wherein an upper end of the external air guide is higher than the lower surface portion of the first heat dissipation cover and is lower than the upper surface portion of the first heat dissipation cover.

18. The entrance refrigerator of claim 17, wherein the external air guide includes:

a base coupled to the upper surface portion of the second heat dissipation cover, the base including a first side spaced apart from a second side in the horizontal direction;

wherein the external air guide includes the inclined portion and the rounded portion, wherein the inclined portion extends from each of the first side and the second side of the base, wherein the rounded portion extends from each inclined portion; and wherein a vertical portion extends from each rounded portion.

* * * * *